US009835419B2

(12) United States Patent
Andrews et al.

(10) Patent No.: US 9,835,419 B2
(45) Date of Patent: Dec. 5, 2017

(54) METHOD AND SYSTEM FOR ARMORED ENERGY-DISPERSION OBJECTS

(71) Applicant: Great Lakes Armor Systems, Inc., Norton Shores, MI (US)

(72) Inventors: Mark D. Andrews, Petoskey, MI (US); Ron J. Hanna, Petoskey, MI (US)

(73) Assignee: Great Lakes Armor Systems, Inc., Petoskey, MI (US)

( * ) Notice: Subject to any disclaimer, the term of this patent is extended or adjusted under 35 U.S.C. 154(b) by 0 days.

(21) Appl. No.: 15/163,145

(22) Filed: May 24, 2016

(65) Prior Publication Data

US 2016/0265884 A1 Sep. 15, 2016

Related U.S. Application Data

(62) Division of application No. 13/374,593, filed on May 25, 2012, now Pat. No. 9,347,746.

(60) Provisional application No. 61/198,409, filed on May 27, 2011.

(51) Int. Cl.

| | |
|---|---|
| ***F41H 5/04*** | (2006.01) |
| ***C23C 8/46*** | (2006.01) |
| ***F41H 7/00*** | (2006.01) |

(52) U.S. Cl.

CPC ..... *F41H 5/0492* (2013.01); *C23C 8/46* (2013.01); *F41H 5/0414* (2013.01); *F41H 5/0442* (2013.01); *F41H 7/00* (2013.01)

(58) Field of Classification Search

CPC ..... F41H 5/0492; F41H 5/08; F41H 5/007; F41H 5/02; F41H 5/04; F41H 5/00; F41H 7/042; F41H 7/04

See application file for complete search history.

(56) References Cited

U.S. PATENT DOCUMENTS

| | | | |
|---|---|---|---|
| 315,077 | A | 4/1885 | Seale |
| 952,877 | A | 3/1910 | Cowper-Coles |
| 1,463,498 | A | 7/1923 | Burgess |

(Continued)

FOREIGN PATENT DOCUMENTS

| | | | |
|---|---|---|---|
| EP | 0041271 A1 | 12/1981 | |
| FR | 2632393 A1 | 12/1989 | |
| WO | WO 2012054117 A2 * | 4/2012 | ..... F41H 5/0421 |

*Primary Examiner* — Benjamin P Lee

(74) *Attorney, Agent, or Firm* — Jonathan M. Rixen; Lemaire Patent Law Firm, P.L.L.C.

(57) ABSTRACT

An armor system that includes a first armor article that includes a plurality of energy-dispersion objects arranged in a predetermined configuration, wherein the plurality of energy-dispersion objects includes a plurality of hollow objects, and wherein at least some of the plurality of hollow objects are filled with an inner filler material; and a lock mechanism configured to hold the plurality of energy-dispersion objects in the predetermined configuration. A method for manufacturing an armor system, the armor system including a first armor article, the method including producing a plurality of hollow hemispheres; affixing pairs of the plurality of hemispheres to one another to form a first plurality of spheres; treating each one of the plurality of hemispheres with an anti-ballistic treatment; inserting a filler material into each one of the plurality of hemispheres; and locking the first plurality of spheres into a predetermined configuration.

20 Claims, 16 Drawing Sheets

(56) References Cited

U.S. PATENT DOCUMENTS 2,068,785 A 1/1937 Bain et al.
2,318,301 A 5/1943 Eger
2,738,297 A 3/1956 Pfistershammer
2,922,483 A 1/1960 Harris
3,324,768 A 6/1967 Eichelberger
3,431,818 A 3/1969 King
3,523,057 A * 8/1970 Buck ..... B29C 70/64 109/24
3,705,558 A 12/1972 McDougal et al.
3,969,563 A 7/1976 Hollis, Sr.
4,179,979 A 12/1979 Cook et al.
4,665,794 A 5/1987 Gerber et al.
5,134,725 A 8/1992 Yeshurun et al.
5,149,910 A 9/1992 McKee
5,170,690 A 12/1992 Smirlock et al.
5,200,256 A 4/1993 Dunbar
5,352,304 A 10/1994 DeArdo et al.
5,361,678 A 11/1994 Roopchand et al.
5,364,679 A * 11/1994 Groves ..... B32B 3/10 109/49.5
5,738,925 A * 4/1998 Chaput ..... B32B 3/10 2/2.5
5,866,839 A * 2/1999 Ohayon ..... F41H 5/02 89/36.02
5,976,656 A 11/1999 Giraud
6,465,047 B1 10/2002 Scott et al.
6,575,075 B2 * 6/2003 Cohen ..... F41H 5/0428 89/36.02
7,238,730 B2 7/2007 Apichatachutapan et al.
7,383,762 B2 6/2008 Cohen
7,490,539 B2 * 2/2009 Ma ..... F41H 5/0492 89/36.01
7,543,523 B2 * 6/2009 Hunn ..... F41H 5/0421 89/36.02
7,562,612 B2 * 7/2009 Lucuta ..... F41H 5/0428 89/36.02
7,694,621 B1 * 4/2010 Ma ..... F41H 5/013 89/36.02
7,833,627 B1 * 11/2010 Ferrando ..... F41H 5/0442 428/416
8,096,223 B1 1/2012 Andrews
8,220,378 B2 * 7/2012 Gamache ..... F41H 5/0492 89/36.02
8,322,267 B2 * 12/2012 Altergott ..... F41H 5/04 29/402.09
8,333,029 B1 * 12/2012 Noveske ..... C23C 8/02 42/76.1
9,207,048 B1 * 12/2015 Roland ..... F41H 5/0492
2006/0243127 A1 * 11/2006 Cohen ..... F41H 5/0492 89/36.02
2007/0017360 A1 * 1/2007 Cohen ..... F41H 5/023 89/36.08
2009/0120272 A1 * 5/2009 Posniak ..... C23C 8/22 89/36.02
2009/0145289 A1 * 6/2009 Cohen ..... F41H 5/0492 89/36.02
2010/0083862 A1 * 4/2010 Ciesiun ..... F42B 6/10 102/513
2010/0101402 A1 * 4/2010 Ma ..... F41H 5/0492 89/36.02
2012/0312150 A1 * 12/2012 Gamache ..... F41H 5/0492 89/36.02
2014/0007761 A1 * 1/2014 Haidar ..... F41H 7/042 89/36.02
2014/0033908 A1 * 2/2014 Grozdanich ..... F41H 5/02 89/36.02
2014/0137726 A1 * 5/2014 Wagner ..... F42D 5/045 89/36.02

* cited by examiner

METHOD AND SYSTEM FOR ARMORED ENERGY-DISPERSION OBJECTS

CROSS-REFERENCE TO RELATED APPLICATIONS

This application is a divisional of U.S. patent application Ser. No. 13/374,593 filed May 25, 2012 (which issued as U.S. Pat. No. 9,347,746 on May 24, 2016), titled "ARMORED ENERGY-DISPERSION OBJECTS AND METHOD OF MAKING AND USING," which claims priority benefit under 35 U.S.C. §119(e) of U.S. Provisional Patent Application No. 61/198,409 filed May 27, 2011 by Mark Andrews, titled "ARMORED GLASS-FILLED NYLON AND METHOD OF MAKING AND USING," each of which is incorporated herein by reference in its entirety.

This application is related to U.S. Provisional Patent Application 61/018,840 filed on Jan. 3, 2008, titled "PASSIVE ARMOR APPARATUS AND METHOD," U.S. Provisional Patent Application 61/068,886 filed on Feb. 13, 2008, titled "MULTI-LAYERED COMPOSITE STRUCTURE AND METHOD OF MAKING AND USING," U.S. Provisional Patent Application 61/119,023 filed on Dec. 1, 2008, titled "MULTI-LAYER COMPOSITE ARMOR AND METHOD," U.S. patent application Ser. No. 12/347,937 filed on Dec. 31, 2008 (which issued as U.S. Pat. No. 8,096,223 on Jan. 17, 2012), titled "MULTI-LAYER COMPOSITE ARMOR AND METHOD," and U.S. patent application Ser. No. 12/371,041 filed on Feb. 13, 2009 (which issued as U.S. Pat. No. 8,365,649 on Feb. 5, 2013), titled "MULTI-LAYERED COMPOSITE BELLY PLATE AND METHOD OF MAKING AND USING," each of which is incorporated herein by reference in its entirety.

FIELD OF THE INVENTION

The present invention provides armored energy-dispersion objects and methods of making and using, and in particular, various embodiments described herein relate to using the objects as passive armor for, e.g., land vehicles, ships, aircraft, and buildings.

BACKGROUND OF THE INVENTION

In combat vehicles, armor is generally placed on the vehicle to protect the occupants from injury or to lessen the type and severity of injuries received when an enemy hits the combat vehicle with a projectile.

In addition, combatants are constantly working to improve projectile apparatus and methods of deployment. In some instances, the projectiles are improved to increase their ability to pierce armor of various types. Similarly, other combatants seek to improve armor to defeat the latest in projectile technology. Therefore, combatants are constantly seeking to improve armor to protect the troops that operate combat vehicles.

U.S. Pat. No. 2,318,301 to Eger issued May 4, 1943 titled "BULLET RESISTING ARMOR" and is incorporated herein by reference. In this patent, Eger describes a plurality of metal strips embedded in overlapping relation in a rubber composition, each strip lying at an angle of approximately 45 degrees to the exposed face of the armor, and including a cushion of rubber composition lying at the back of the plurality of strips, and also including a metal base plate bonded to the cushion of rubber composition.

U.S. Pat. No. 2,738,297 to Pfistershammer issued Mar. 13, 1956 titled "HONEY-COMB-TYPE STRUCTURAL MATERIALS AND METHOD OF MAKING SAME" and is incorporated herein by reference. In this patent, Pfistershammer describes structural materials having a lattice-like form and consisting at least in part of a component of great strength and ductility (basic material) such as steel, aluminum and the like, or a synthetic material of suitable nature, such as a polyamide, at least part of the basic material being formed in such a manner as to provide curved lines of stress in every direction of stress of the structure.

U.S. Pat. No. 3,324,768 to Eichelberger issued Jun. 13, 1967 titled "PANELS FOR PROTECTION OF ARMOR AGAINST SHAPED CHARGES" and is incorporated herein by reference. In this patent, Eichelberger describes panels which may be applied over the armor of combat tanks to enable such vehicles to better resist, withstand and combat the heretofore serious offensive power of weapons employing shaped charge projectiles.

U.S. Pat. No. 3,431,818 to King issued Mar. 11, 1969 titled "LIGHTWEIGHT PROTECTIVE ARMOR PLATE" and is incorporated herein by reference. In this patent, King describes an improved lightweight armor plate comprising a plurality of energy-dissipating elements embedded in a non-metallic body in spaced apart relationship, wherein a minimum number of the energy-dissipating elements are adapted to be shattered when subjected to the impact of a projectile thereagainst while causing fragmentation of the projectile to effectively dissipate its energy so as to stop or divert the projectile.

U.S. Pat. No. 5,149,910 to McKee issued Sep. 22, 1992 titled "POLYPHASE ARMOR WITH SPOILER PLATE" and is incorporated herein by reference. In this patent, McKee describes composite armor comprising a corrugated metal spoiler plate in front of and spaced from high alumina ceramic tiles backed by an aluminum anvil.

U.S. Pat. No. 5,170,690 to Smirlock et al. issued Dec. 15, 1992 titled "SURVIVABILITY ENHANCEMENT" and is incorporated herein by reference. In this patent, Smirlock et al. describe a survivability enhancement system that includes first separable fastener structure fixed on the surface of the vehicle or system whose survivability is to be enhanced, and an array of armor tiles. The armor tiles provide a composite supplementary layer of armor that maintains attachment at effective levels even as armor tiles are subjected to large shear forces (for example, upon ballistic impact and shattering of an adjacent tile) and that has effective force dissipation characteristics. Each armor tile has opposed surfaces with second separable fastener structure complementary to the first separable fastener structure secured to one of its surfaces, one of the separable fastener structures having a multiplicity of projecting hooking elements and the cooperating fastener structure having complementary structure that is releasably interengageable with the hooking elements.

U.S. Pat. No. 7,238,730 to Apichatachutapan et al. issued Jul. 3, 2007 titled "VISCOELASTIC POLYURETHANE FOAM" and is incorporated herein by reference. In this patent, Apichatachutapan et al. describe a viscoelastic polyurethane foam being flame retardant and having a density of greater than two and a half pounds per cubic foot that comprises a reaction product of an isocyanate component, an isocyanate-reactive blend, and a chain extender. The isocyanate-reactive blend includes a first isocyanate-reactive component and a second isocyanate-reactive component. The first isocyanate-reactive component includes at least 60 parts by weight of ethylene oxide (EO) based on 100 parts by weight of the first isocyanate-reactive component and the second isocyanate-reactive component includes at most 30 parts by weight of EO based on 100 parts by weight of the second isocyanate-reactive component. The chain extender is reactive with the isocyanate component and has a backbone chain with from two to eight carbon atoms and is present in an amount of from 5 to 50 parts by weight based on 100 parts by weight of the foam. A composition useful in making the viscoelastic polyurethane foam is also disclosed.

There is a need for improved armor for vehicles and buildings.

SUMMARY OF THE INVENTION

In some embodiments, the present invention provides an armor system that includes a first armor article that includes a plurality of energy-dispersion objects arranged in a predetermined configuration, wherein the plurality of energy-dispersion objects includes a plurality of hardened-shell (initially hollow) objects, and wherein at least some of the plurality of hollow objects are filled with an inner filler material; and a lock mechanism configured to hold the plurality of energy-dispersion objects in the predetermined configuration.

In some embodiments, the present invention provides a method for manufacturing an armor system, the armor system including a first armor article, the method including producing a plurality of hardened-shell hemispheres; affixing pairs of the plurality of hemispheres to one another to form a first plurality of spheres; treating each one of the plurality of hemispheres with an anti-ballistic treatment; inserting a filler material into each one of the plurality of hemispheres; and locking the first plurality of spheres into a predetermined configuration.

BRIEF DESCRIPTION OF THE DRAWINGS

FIG. 9A-2 is a perspective view of multi-layer armor unit 901 after complete assembly.

FIG. 10A-1 is a perspective view of a multi-layer square-packed armor unit 1001 prior to complete assembly.

FIG. 10A-2 is a perspective view of multi-layer armor unit 1001 after complete assembly.

DETAILED DESCRIPTION

Figure 1B:
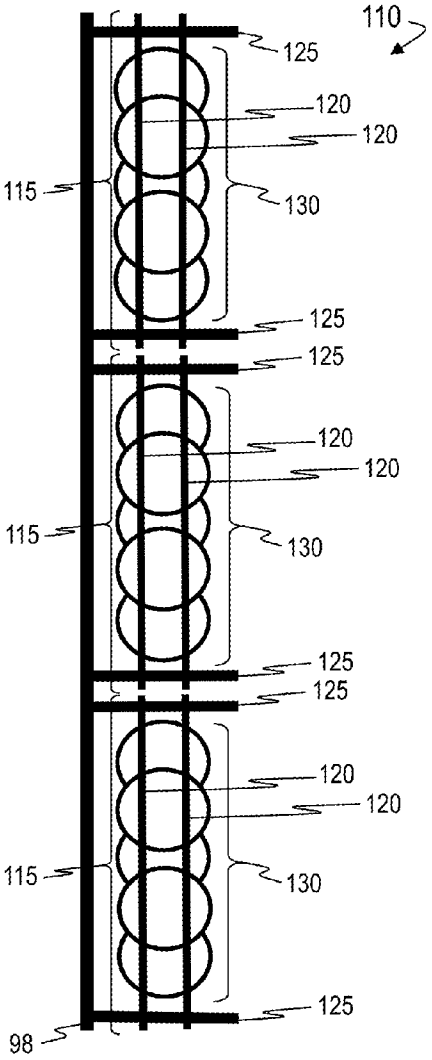
FIG. 1B is a side view of armor system 110.

Although the following detailed description contains many specifics for the purpose of illustration, a person of ordinary skill in the art will appreciate that many variations and alterations to the following details are within the scope of the invention. Accordingly, the following preferred embodiments of the invention are set forth without any loss of generality to, and without imposing limitations upon the claimed invention.

In the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention.

The leading digit(s) of reference numbers appearing in the Figures generally corresponds to the Figure number in which that component is first introduced, such that the same reference number is used throughout to refer to an identical component that appears in multiple figures. Signals and connections may be referred to by the same reference number or label, and the actual meaning will be clear from its use in the context of the description.

As used herein, "improvised explosive devices" (IEDs) are weapons that are constructed and deployed in ways other than in conventional military action, and that, when activated, generate both blast waves and ballistic projectiles (typically shrapnel). IEDs are often placed on roads so as to be detonated when vehicles or pedestrians pass by, and therefore are commonly associated with attacks that are directed to the bottom side of a vehicle. As used herein, a "ballistic projectile" is defined as an explosively-generated penetrating device or material (such as shrapnel) that is typically used to attack a vehicle or combatant, and that travels unpowered through the air after being explosively-generated (e.g., a bullet is a type of ballistic projectile). A ballistic projectile includes any penetrating object formed as the result of an IED. For example, the ballistic projectiles from an IED can have a shaped-charge warhead such as an explosively-formed penetrator (EFP), or in the case of most other IEDs, the projectiles from an IED are shrapnel. In the latter case, shrapnel is either produced by the casing of the IED (i.e., artillery shell), or embedded material within the IED to produce shrapnel. Perhaps the most powerful result of an IED explosion is the actual blast itself. For example, an IED used as an anti-tank mine will breach the hull of a tank with the sheer force of an explosive blast alone (substantially no fragments or shrapnel). In contrast to a ballistic projectile, a missile is typically powered (e.g., by rocket or jet exhaust) for at least a portion of its flight (e.g., a rocket-propelled grenade (RPG) is a type of missile). As used herein, an "anti-ballistic material" is defined as a material that is designed to destroy/defeat ballistic projectiles and/or missiles.

As used herein, the "strike-face side" or "strike face" of an armor configuration is defined as the side of the armor in which a ballistic projectile/missile or blast wave first comes into contact. For example, an explosively-formed-penetrator (EFP) shot at an armor-protected vehicle from a position external to the vehicle will make first contact with the armor on the strike-face side of the armor. Similarly, the "vehicle side" of an armor configuration is herein defined as the side of the armor closest to the hull or protected volume of the vehicle being protected.

Figure 1A:
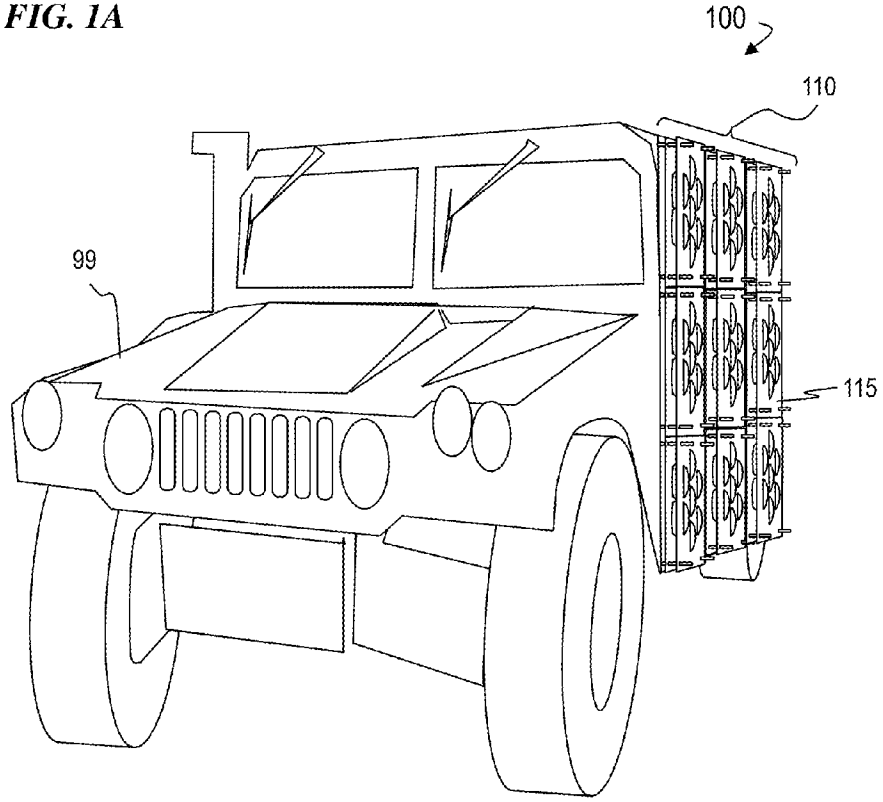
FIG. 1A is a perspective view of an armored vehicle.
Figure 14:
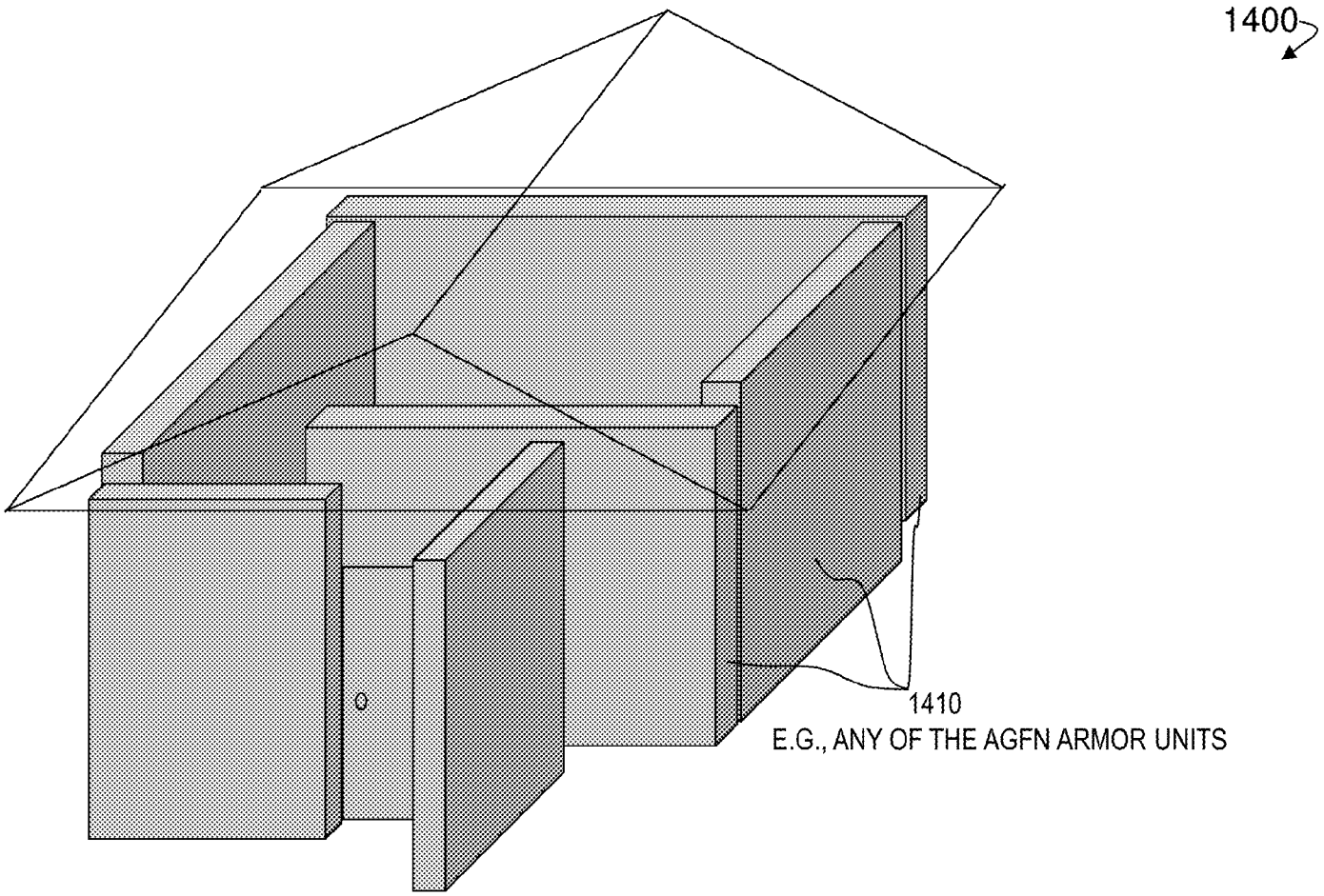
FIG. 14 is a perspective view of an armor-enhanced stationary structure 1400.

FIG. 1A is a perspective view of an armored vehicle system 100. In some embodiments, the sides of vehicle 99 are covered with an armor system 110 to protect from improvised explosive devices (IEDs) or rocket-propelled grenades (RPGs) that are often directed toward a vehicle from the sides (only the armor system 110 on one side of vehicle 99 is visible in the perspective view shown in FIG. 1A, but, in some embodiments, each side of vehicle 99 is covered with an armor system 110). In some embodiments, as shown in FIG. 1A, the sides of vehicle 99 are protected by an armor system 110 that includes a plurality of individual armor units 115 (in some embodiments, armor units 115 are referred to as "anti-ballistic units" or "armor tiles"). In other embodiments, the sides of vehicle 99 are protected by an armor system 110 that has a single armor unit 115. In some embodiments, armor system 110 is configured to conform to a substantially flat surface such as vehicle hull 98. In other embodiments, armor system 110 is configured to conform to a substantially curved surface (see, e.g., FIG. 15). Armor system 110 protects passengers or troops within vehicle 99 from explosions which may occur near vehicle 99 and/or from ballistic projectiles (e.g., such as from explosively-formed-penetrator devices or "EFPs") and missiles (e.g., such as rocket-propelled grenades or RPGs) that may strike or be directed at vehicle 99 from the side. In some embodiments, armor system 110 is configured to defend against ballistic projectiles (e.g., EFP's) in the 152-170 millimeter (mm) (outside diameter) range (this range is based on the size of oil pipes that are often used to create EFP's). In other embodiments, armor system 110 is configured to defend against other suitable sizes of ballistic projectiles/missiles. In some embodiments, additional armor units 110 are provided on the back, front, underbelly, and/or top of vehicle 99 to protect from ballistic projectiles/missiles aimed at those aspects of vehicle 99. In some embodiments, vehicle 99 is a HMVVW (humvee)-type vehicle as shown. In some embodiments, vehicle 99 is a 4×4×4 M-APEX, a 6×6×6 Desert Chameleon, or an 8×8×8 Desert Chameleon combat vehicle such as provided by Advanced Defense Vehicle Systems (ADVS) (www.advs.com/ADVS/Products.html). In some embodiments, vehicle 99 is a tank, ship, aircraft (e.g., in some embodiments, a rotary-wing aircraft such as a helicopter), limousine, or like vehicle. In some embodiments, armor system 110 is applied to a structure such as a house or bunker, such as shown in FIG. 14 below. In still other embodiments, armor system 110 is used for individual body armor (see FIG. 16).

FIG. 1B is a side view of armor system 110. Three of the individual armor units 115 of armor system 110 can be seen in FIG. 1B, and in some embodiments, each armor unit 115 includes a plurality of energy-dispersion objects 130 held in place by two or more lock plates 120. In some embodiments, armor units 115 are attached to vehicle hull 98 such that minimal or no space is present between each unit 115. In some embodiments, lock plates 120 include a plurality of holes and each hole has a diameter that is slightly smaller than the outside diameter of an individual energy-dispersion object 130 such that a layer of energy-dispersion objects 130 can be held in place between two lock plates 120 (the "outside diameter" of energy-dispersion objects in the description of the present invention is sometimes referred to simply as the "diameter"). In some embodiments, energy-dispersion objects 130 are also welded to lock plates 120. In some embodiments, lock plates 120 are made from a metal or metal alloy (e.g., in some embodiments, aluminum), a composite material (e.g., in some embodiments, a polymer-based composite material such as carbon fiber or Kevlar®), or any other suitable material. In some embodiments, lock plates 120 are held together using fastener sets 125 (in some embodiments, each fastener set 125 includes a combination of nut(s), bolt(s), washer(s), and/or other suitable fasteners). In some embodiments, armor system 110 is bolted directly to the vehicle hull 98 of vehicle 99 (e.g., in some embodiments, armor system 110 is bolted to vehicle hull 98 using bolts from the fastener sets 125). In some embodiments, armor system 110 is placed into a pocket that forms part of vehicle hull 98 (see, e.g., vehicle pocket(s) 1580 of FIG. 15).

As used herein, "energy-dispersion objects" are defined as resilient and hard objects that are configured to dissipate the noise, vibration, and energy associated with a ballistic projectile/missile or explosion. In some embodiments, energy-dispersion objects 130 are spheres or other suitable shapes made from a metal or metal alloy (e.g., in some embodiments, energy-dispersion objects 130 are made from 4330 alloy steel), the spheres undergo an anti-ballistic treatment such as case hardening (see below), and the treated spheres are filled with a glass-filled nylon.

As used herein an "anti-ballistic treatment" is defined as a treatment applied to a material or object (e.g., energy-dispersion objects 130) to improve anti-ballistic characteristics (e.g., increasing hardness while maintaining ductility). Anti-ballistic treatments include heat treatments (e.g., normalizing, annealing, quench-and-tempering, and the like) and surface treatments (e.g., case hardening, tool coatings, and the like). In some embodiments, energy-dispersion objects 130 are configured to have a hardness/malleability that optimizes its energy-dispersion properties. That is, if energy-dispersion objects 130 are too hard, the strike from a ballistic projectile/missile will simply shatter energy-dispersion objects 130 and a minimal amount of energy will be dispersed outwards, and, if energy-dispersion objects 130 are too soft, energy-dispersion objects 130 will deform around an incoming ballistic projectile/missile rather than dispersing energy outward toward other energy-dispersion objects 130. In some embodiments, anti-ballistic treatments are applied to an energy-dispersion object 130 such that the surface of the energy-dispersion object increases in hardness, while the core of the energy-dispersion object maintains its ductility (e.g., in some embodiments, energy-dispersion objects 130 undergo case hardening to increase surface hardness, while maintaining core ductility).

As used herein, "normalizing" is defined as the process of heating steel to a temperature in the austenite region followed by an air cool. Normalizing results in a fine pearlitic structure, and a more uniform structure. Normalized steel generally has a higher strength than annealed steel. As used herein, "annealing" is defined as the process of heating steel to a temperature in the austenite region followed by a slow cool. Annealing results in a coarse pearlitic structure (i.e., the bands of pearlite are thick). As used herein, "quench-and-tempering" is defined as the process of reheating quenched (rapidly cooled) steel to a temperature below the eutectoid temperature and then cooling. Quench-and-tempering allows very small amounts of spheriodite to form, which restores ductility, but reduces hardness.

As used herein, "case hardening" is defined as the process of hardening the surface of a metal, often a low-carbon steel, by infusing elements into the material's surface, forming a thin layer of a harder alloy (e.g., in some embodiments, the thickness of a case-hardened layer is in a range of about 0.5 mm to 0.8 mm (20 to 30 thousandths of an inch)). Examples of case-hardening processes include carbonitriding and carburizing. In some embodiments, an FNC (i.e., ferritic nitrocarburizing, such as, for example, the DYNA-BLUE® process provided by Dynamic Surface Technologies, www.dynablue.com) treatment is applied to an already case hardened material in order to significantly raise its surface hardness. FNC includes various case-hardening processes that diffuse nitrogen and/or carbon into ferrous metals at relatively low (sub-critical) temperatures; these processing temperatures range from 525° C. to 625° C., but usually occurs at 565° C., at which temperature steels and other ferrous alloys are generally in a ferritic phase, which, in some embodiments, can be advantageous compared to other case-hardening processes that occur in the austentic phase. In some embodiments, FNC uses gaseous, salt bath, ion or plasma, and/or fluidized-bed processes.

As used herein, "tool coating" is defined as the process of depositing a thin layer of material on a surface in order to increase the wear-resistance of the surface. In some embodiments, a tool coating creates a layer of material having a thickness of about a few thousandths of a millimeter. Tool coating processes include BALINIT® tool coatings provided by Oerlikon-Balzer (www.oerlikon.com/balzers/en/products-services/balinit-coatings/).

In some embodiments, energy-dispersion objects 130 that contain a glass-filled nylon and undergo an anti-ballistic treatment are sometimes referred to as "armored glass-filled nylon" or "AGFN" energy-dispersion objects in the description of the present invention. In some embodiments, AGFN energy-dispersion objects have only a small fraction of the weight of solid steel spheres having the same approximate outside diameter, but still provide substantially similar strength and/or hardness. In some embodiments, AGFN is configured to protect against EFPs (explosively-formed penetrators) and/or bullets. In some embodiments, AGFN energy-dispersion objects are configured to protect against Misznay-Schardin-effect shape-charged penetrators including RPG (rocket-propelled grenade), HEAT (high-explosive anti-tank), LAW (light anti-tank weapon), TOW (tube-launched optically-tracked, wire-guided missile), or the like due to forcing the penetrator to encounter at least two energy-dispersion objects 130 (e.g., in some embodiments, each individual armor unit 115 includes two or more layers of energy-dispersion objects 130 offset from each other by about 45 degrees such that a ballistic projectile/missile fired at armor system 110 must encounter at least two energy-dispersion objects 130 (see, e.g., FIG. 5B). In some embodiments, AGFN is further configured to protect against DEW (directed-energy weapons; e.g., lasers, sonic weapons, or the like) with the proper surface treatment (e.g., a tool coat such as a BALINIT® tool coating). In some embodiments, high-strength shaped materials covered by an "armor grade" steel (e.g., steel produced to military standard MIL-DTL-12560, case-hardened 4330 steel, or the like) or other high-strength anti-ballistic material form the basic unit (e.g., energy-dispersion objects 130) of a network of composite anti-ballistic tiles (e.g., armor units 115) which are held or suspended together in matrix to form the mosaic of anti-ballistic armor system 110.

In some embodiments, armor system 110 includes a combination of AGFN energy-dispersion objects 130 and hollow structures that are not filled with glass-filled nylon (or any other material) in order to produce a more light-weight armor. In some embodiments, armor system 110 includes only hollow energy-dispersion objects that are filled with air, gas, or lightweight gel or foam and do not have an injection port (e.g., in some embodiments, energy-dispersion-object halves are welded together with the desired filler already inside the halves).

In some embodiments, as shown in FIG. 1A, energy-dispersion objects 130 within each armor unit 115 are arranged in a hexagonal-packed configuration. As used herein, a "hexagonal-packed" configuration is defined as the arrangement of a plurality of energy-dispersion objects in a first layer such that each one of the plurality of energy-dispersion objects (of those not in the outer perimeter of objects) contacts or nearly contacts six other energy-dispersion objects in the first layer. As used herein, a "square-packed" configuration is defined as the arrangement of a plurality of energy-dispersion objects in a first layer such that each one of the plurality of energy-dispersion objects (of those not in the outer perimeter of objects) contacts or nearly contacts four other energy-dispersion objects in the first layer. In some embodiments, the "square-packed" configuration is used rather than the "hexagonal-packed" configuration because it weighs less for a given area of armor having a given size of energy-dispersion objects.

In some embodiments, instead of using lock plates 120, AGFN energy-dispersion objects 130 are held in place in the desired configuration using a polymer. For example, in some such embodiments, AGFN energy-dispersion objects 130 are bonded together using deadened non-rebounding polyurethane (e.g., viscoelastic polyurethane such as provided by U.S. Pat. No. 7,238,730, titled "VISCOELASTIC POYURETHANE FOAM", issued Jul. 3, 2007). In some embodiments, AGFN energy-dispersion objects 130 are bonded together using a high-tensile-strength polyurethane such as obtained using Andur 5 DPLM-brand prepolymer (Andur 5-DPLM is a polyester based, toluene diisocyanate terminated prepolymer. An elastomer with a hardness of 50 Shore D is obtained when this prepolymer is cured with Curene 442 [4,4'-methylene-bis(orthochloroaniline)]. Elastomers of lower hardness can be obtained by curing Andur 5-DPLM with polyols and their combination with Curene 442 and other diamines, or through the use of plasticizers), wherein 5 DPLM and Curene 442 are available through Anderson Development Corporation (www.andersondevelopment.com/surv_bin.php?x={486D54-005531-7D34C9}&y=1). In some embodiments, armor system 110 (including lock plates 120, fastener sets 125, and energy-dispersion objects 130) are encased within a polymer such as the polyurethanes described above. In some embodiments, instead of using lock plates 120, AGFN energy-dispersion objects 130 are welded to each other to maintain the desired configuration. In some embodiments, instead of using lock plates 120, AGFN energy-dispersion objects 130 are held together using any other suitable method including metallically, chemically, electromagnetically, or the like.

In some embodiments, armor system 110 is modular, interchangeable, and replaceable. That is, in some embodiments, a portion of armor system 110 (including one or more armor units 115 or a portion of a single armor unit 115) can be destroyed and replaced without having to replace the entire armor system 110. In some embodiments, this modular armor system 110 can be adjusted based on the applicable threat level. For example, in some embodiments, the mass and/or tile size of armor units 115 is adjusted based on the corresponding size and overall ballistic energy of potential threat weapons. In some such embodiments, modification to armor units 115 and thus armor system 110 is performed at the troop/user level with only a crescent wrench, or in the case of an "internal compartment" configuration (see definition below), with no tools at all.

In some embodiments, armor system 110 is designed such that ballistic pressure and force from a ballistic projectile or missile is brought to bear on energy-dispersion objects 130 such that energy-dispersion objects 130 are preferably destroyed rather than the overall structure of armor system 110. In some embodiments, armor system 110 is mutually supporting such that individual tiles (i.e., armor units 115) are offset so as to cover "openings" in system 110 between individual tiles 115 and between layers of tiles (see, e.g., FIG. 4).

Armor system 110 can be attached to the vehicles/buildings it is configured to protect in multiple ways. In some embodiments, for example, armor system 110 is used as an appliqué (i.e., armor system 110 is attached to the exterior surface of the vehicle, such as shown in FIG. 1A). In other embodiments, armor system 110 is arranged in an "internal compartment" configuration (see, e.g., FIG. 15). As used herein, an "internal compartment" configuration is defined as the arranging of the individual armor units 115 in a compartment (e.g., a steel compartment or pocket) forming the exterior of the vehicle 99 and/or the vehicle hull 98. In an internal compartment configuration, fastener sets 125 are not necessarily needed (and thus tools are not needed to disassemble/modify an internal compartment configuration) because the dimensions of the internal compartment can be made small enough to hold energy-dispersion objects 130 in place between lock-plates 120 without tightening from fastener sets 125. In some internal compartment embodiments, the dimensions of the internal compartment are such that neither fastener sets 125 nor lock-plates 120 are required.

Figure 2B:
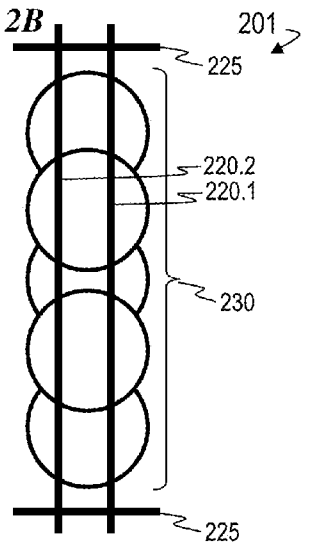
FIG. 2B is a side view of hexagonal-packed armor unit 201.
Figure 2D:
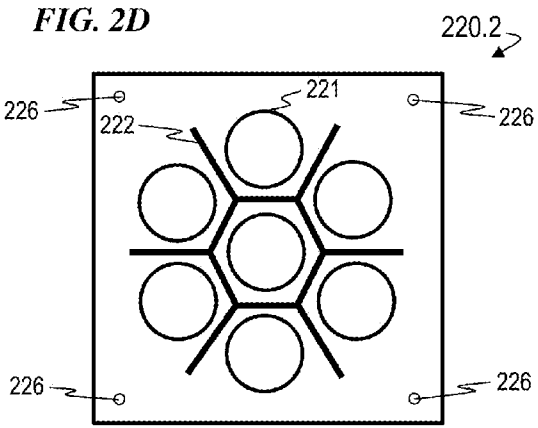
FIG. 2D is a rear view of vehicle-side lock plate 220.2.
Figure 2A:
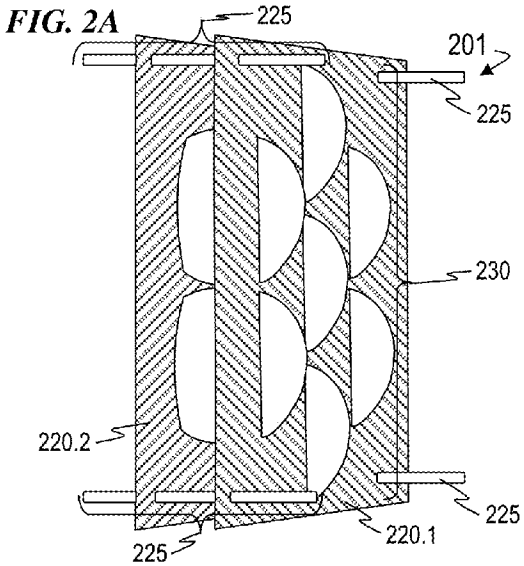
FIG. 2A is a perspective view of a hexagonal-packed armor unit 201.

FIG. 2A is a perspective view of a hexagonal-packed armor unit 201. In some embodiments, armor unit 201 is one of a plurality of individual armor units 201 that are affixed to an area of a vehicle to protect that area of the vehicle from ballistic projectiles and/or missiles. In some embodiments, armor unit 201 includes a plurality of energy-dispersion objects 230 (in some embodiments, as shown in FIG. 2A, armor unit 201 includes five individual energy-dispersion objects 230 arranged in a single hexagonal-packed layer, while in other embodiments, armor unit 201 includes any other suitable number of energy dispersion objects 230 arranged in one or more hexagonal-packed layers). In some embodiments, each individual energy-dispersion object 230 has a diameter that is about 102 mm (4 inches). In other embodiments, each individual energy-dispersion object 230 has any other suitable diameter. In some embodiments, energy-dispersion objects 230 are hardened-shell hollow spheres made from 4330-type steel that undergo anti-ballistic treatments (e.g., heat treatments and surface treatments) and are filled with a glass-filled nylon such as 30% glass fiber Nylon-6 (e.g., in some embodiments, energy-dispersion objects 230 are filled with LGF30-PA6 1001 NAT glass-filled nylon from a supplier such as PlastiComp LLC, 110 Galewski Drive, Winona Minn. 55987). In some embodiments, energy-dispersion objects 230 are made from any other suitable material including 1010 steel, 1020 steel, 1030 steel, 4130 steel, and 8620 steel. In some embodiments, energy-dispersion objects 230 are carbonitrided and FNC-treated. In some embodiments, energy-dispersion objects 230 are carbonitrided and tool-coated (e.g., a BALINIT® tool coating such as provided by Oerlikon-Balzer). In some embodiments, energy-dispersion objects 230 undergo any other suitable combination of anti-ballistic treatments.

In some embodiments, energy-dispersion objects 230 are held in place by two lock plates 220 (i.e., a strike-face lock plate 220.1 and a vehicle-side lock plate 220.2). In some embodiments, each lock plate 220 includes a plurality of holes (e.g., in some embodiments, each lock plate 220 includes five holes, one for each energy-dispersion object 230), wherein each hole has a diameter that is slightly smaller than the diameter of the energy-dispersion objects 230 such that energy-dispersion objects 230 can be held in place in the hexagonal-packed configuration between the two lock plates 220. In some embodiments, lock plates 220 are made from a material that includes a metal (e.g., aluminum, low-carbon 1018 steel, armor-grade steels (e.g., steels produced to military standards MIL-DTL-12560 or MIL-DTL 46177), or the like). In some embodiments, lock plates 220 are made from a material that includes a composite material (e.g., carbon fiber, glass-filled nylon, or the like). In some embodiments, each lock plate 220 has a thickness of about 3.2 mm (⅛ inch). In some embodiments, each lock plate 220 has any other suitable thickness. In some embodiments, each lock plate 220 has a length-width dimension of about 406 mm by 406 mm (16 inches by 16 inches). In some embodiments, each lock plate 220 has a length-width dimension of about 457 mm by 457 mm (18 inches by 18 inches). In some embodiments, each lock plate 220 has a length-width dimension that is smaller than about 610 mm by 1, 219 mm (2 feet by 4 feet) such that an individual person could replace/install armor unit 201 alone. In some embodiments, each lock plate 220 has a length-width dimension that is larger than about 610 mm by 1,219 mm (2 feet by four feet). In some embodiments, each lock plate 220 has a length-width dimension that is smaller than about 406 mm by 406 mm (16 inches by 16 inches). In some embodiments, lock plates 220 are held together using a plurality of fastener sets 225. In some embodiments, as shown in FIG. 2A, armor unit 201 includes four fastener sets 225, wherein one fastener set 225 is located at each corner of armor unit 201. In other embodiments, armor unit 201 includes any other suitable number of fastener sets 225 and the fastener sets 225 are arranged in any other suitable configuration. In some embodiments, each fastener set 225 includes a combination of nut(s), bolt(s), washer(s), and/or other suitable fasteners.

For example, in some embodiments, each fastener set 225 includes a threaded bolt or rod that passes through both lock plates 220 and at least one nut/washer combination that is placed over the threaded bolt and tightened to keep lock plates 220 together.

FIG. 2B is a side view of hexagonal-packed armor unit 201.

Figure 2C:
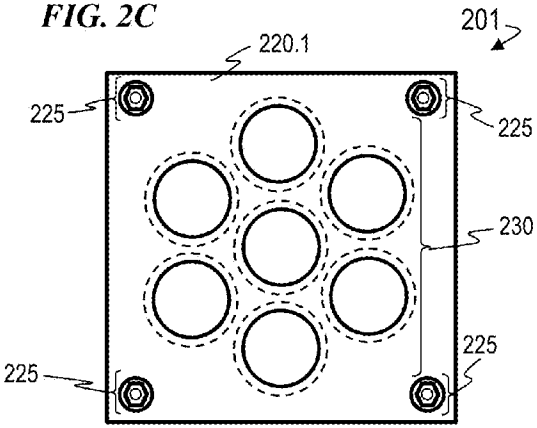
FIG. 2C is a front view of hexagonal-packed armor unit 201.

FIG. 2C is a front view of hexagonal-packed armor unit 201. Each energy-dispersion object 230 is illustrated by a circular solid line and a circular dotted line that surrounds the solid line. The solid line represents the portion of the energy-dispersion object 230 that is visible when looking at strike-face lock plate 220.1, while the dotted line represents the portion of the energy-dispersion object 230 that is behind strike-face lock plate 220.1 and thus not visible in FIG. 2C. In some embodiments, as shown in FIG. 2C, armor unit 201 includes four fastener sets 225 and each set is located at one corner of strike-face lock plate 220.1 (vehicle-side lock plate 220.2 also includes four fastener sets 225, but is not visible in FIG. 2C). In other embodiments, armor unit 201 includes any other suitable number of fastener sets 225, and the fastener sets 225 are arranged in any other suitable configuration (e.g., in some embodiments, armor unit 201 includes eight fastener sets 225 that are evenly spaced around the perimeter of armor unit 201). In some embodiments, each fastener set 225 includes a bolt, a washer, and a nut.

FIG. 2D is a rear view of vehicle-side lock plate 220.2. In some embodiments, lock plate 220.2 includes a plurality of fastener holes 226 configured to receive the fastener sets 225 of armor unit 201. In some embodiments, lock plate 220.2 includes a plurality of energy-dispersion-object holes 221 that are configured to hold energy-dispersion objects 230 in the hexagonal-packed configuration of armor unit 201. In some embodiments, the vehicle side of lock plate 220.2 (i.e., the side visible in FIG. 2D) is reinforced with solid steel bars 222 that are attached to lock plate 220.2 in the spaces between holes 221. In some embodiments, the strike-face side of lock-plate 220.2 is also reinforced with solid steel bars 222. In some embodiments, each side of lock plate 220.1 and lock plate 220.2 is reinforced with solid steel bars 222. In some embodiments, the strike-face side of lock plate 220.1 is reinforced with solid steel bars 222. In some embodiments, bars 222 are welded to lock plate 220.2. In other embodiments, bars 222 are attached to lock plate 220.2 in any other suitable manner. In some embodiments, bars 222 are made from 1018 steel. In some embodiments, bars 222 are made from any other suitable metal or metal alloy. In some such embodiments, bars 222 are case-hardened.

Figure 3B:
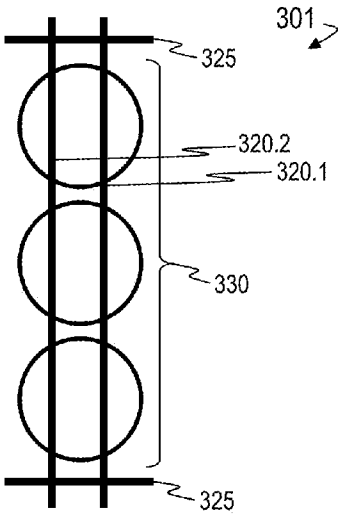
FIG. 3B is a side view of armor unit 301.
Figure 3D:
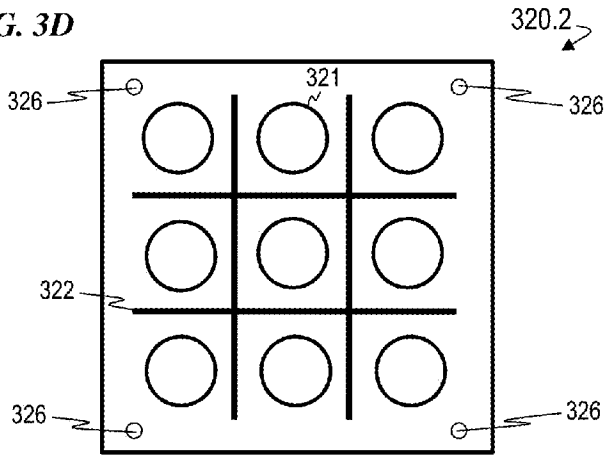
FIG. 3D is a rear view of vehicle-side lock plate 320.2.
Figure 3A:
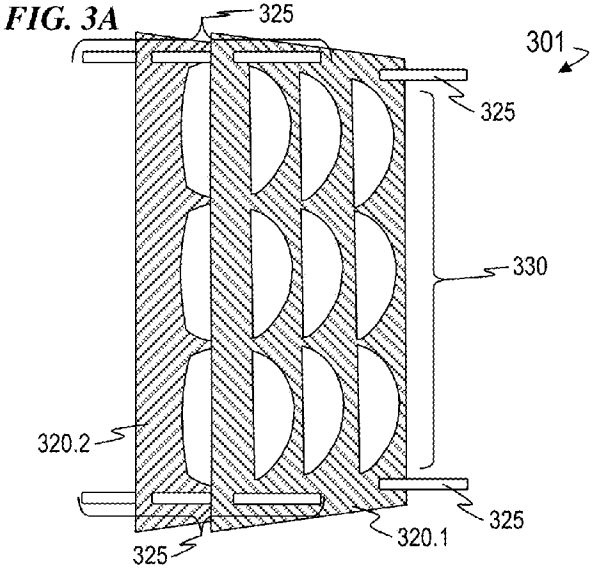
FIG. 3A is a perspective view of a square-packed armor unit 301.

FIG. 3A is a perspective view of a square-packed armor unit 301. In some embodiments, armor unit 301 is substantially similar to armor unit 201 of FIG. 2A except that the hexagonal-packed configuration of energy-dispersion objects 230 in FIG. 2A is replaced with a square-packed configuration of energy-dispersion objects 330. In some embodiments, each individual energy-dispersion object 330 has a diameter that is about 102 mm (4 inches). In some embodiments, as shown in FIG. 3A, armor unit 3 includes six individual energy-dispersion objects 330 arranged in a single square-packed layer, while in other embodiments, armor unit 301 includes any other suitable number of energy dispersion objects 330 arranged in one or more square-packed layers. In some embodiments, energy-dispersion objects 330 are held in place by two lock plates 320 (i.e., a strike-face lock plate 320.1 and a vehicle-side lock plate 320.2), and in some embodiments, lock plates 320 are held together using a plurality of fastener sets 325. In other embodiments, the hexagonally packed, square-packed, or other configuration matrices 301 of energy-dispersion objects are simply contained in a compartment (such as a steel box), or are welded to one another, or are put in an array of tubes that are stacked such that the longitudinal axis of each tube is pointing outward (for example, in some embodiments, the axis of the tube is at a normal-vector angle relative to the surface of the vehicle), and which guide the incoming projectile or other weapon, along a line that dissipates energy (e.g., in some embodiments, that spreads the energy over a wide area) before the weapon reaches the vehicle hull.

FIG. 3B is a side view of armor unit 301.

Figure 3C:
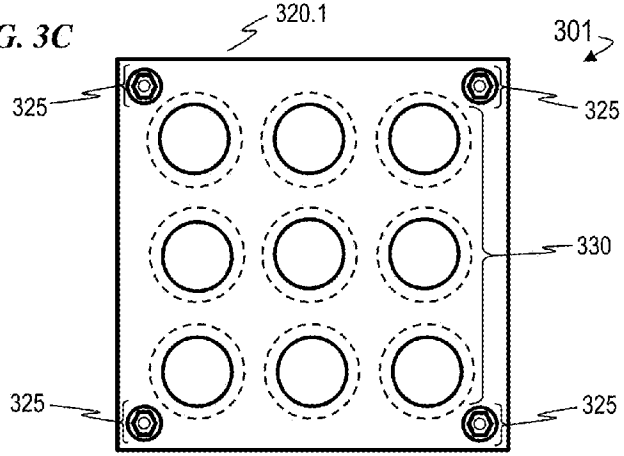
FIG. 3C is a front view of armor unit 301.

FIG. 3C is a front view of armor unit 301.

FIG. 3D is a rear view of vehicle-side lock plate 320.2. In some embodiments, lock plate 320.2 includes a plurality of fastener holes 326 configured to receive the fastener sets 325 of armor unit 301. In some embodiments, lock plate 320.2 includes a plurality of energy-dispersion-object holes 321 that are configured to hold energy-dispersion objects 330 in the square-packed configuration of armor unit 301. In some embodiments, the vehicle side of lock plate 320.2 (i.e., the side visible in FIG. 3D) is reinforced with solid steel bars 322 that are attached to lock plate 320.2 in the spaces between holes 321 (in some embodiments, bars 322 are welded to lock-plate 320.2). In other embodiments, any other combination of sides of lock plate 320.2 and/or 320.1 is reinforced with solid steel bars 322.

Figure 4:
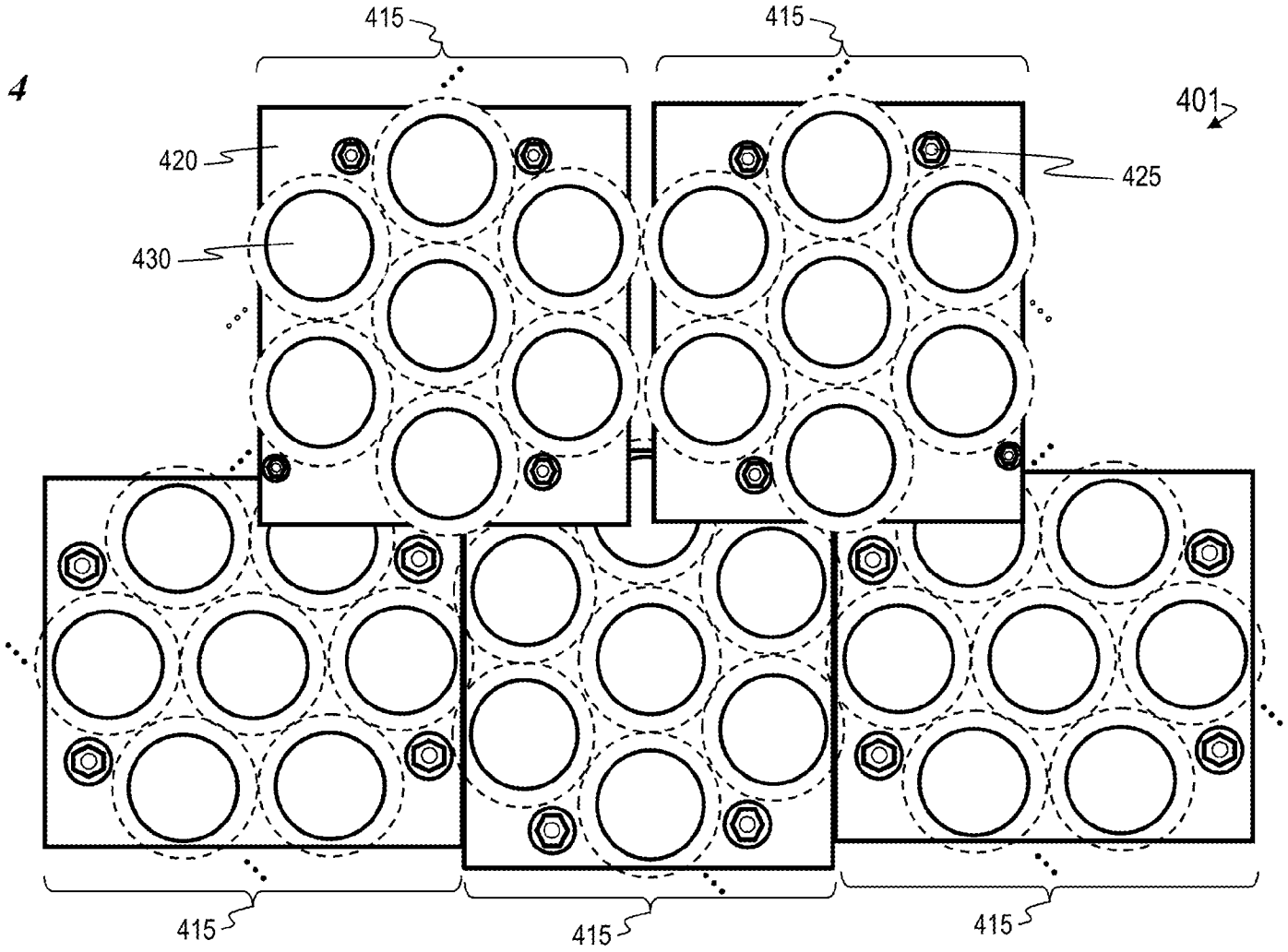
FIG. 4 is front view of an armor system 401.

FIG. 4 is front view of an armor system 401. In some embodiments, system 401 includes a plurality of armor units 415, each armor unit 415 including a plurality of energy-dispersion objects 430 held in place by two or more lock-plates 420 (since FIG. 4 is a front view, only the strike-face lock-plate 420 of each unit 415 is visible in FIG. 4). In some embodiments, the plurality of energy-dispersion objects 430 within each armor unit 415 is configured in a hexagonal-packed configuration and each energy-dispersion object 430 within an armor unit 415 is placed in contact with any adjacent energy-dispersion object 430 in that armor unit 415 (i.e., the energy-dispersion objects 430 within an armor unit 415 touch each other). In some such embodiments, armor units 415 are arranged adjacent to each other such that at least some energy-dispersion objects 430 from separate but adjacent units 415 are also in contact with each other. In still further such embodiments, individual layers of armor units 415 are offset from each other so as to cover "openings" in system 401 between individual layers of armor units 415. In some embodiments, armor units 415 in separate layers contact each other (i.e., energy-dispersion objects 430 within a first layer touch energy-dispersion objects 430 within a second adjacent layer). In other embodiments, armor units 415 in separate layers do not touch each other such that the armor units 415 in the strike-face layer absorb at least some energy from an incoming ballistic projectile/missile before contacting the armor units 415 in the adjacent layer.

Energy-Dispersion Objects

Energy-dispersion objects of the present invention (e.g., energy-dispersion objects 430 of FIG. 4) are configured to help disintegrate ballistic projectiles (e.g., explosion-formed shrapnel or EFPs) or missiles (e.g., RPGs) and spread (mechanically couple the force to a larger area) and/or dissipate (convert some of the energy to heat in the armor) the shrapnel/projectile's kinetic energy before it can reach the hull of the vehicle being protected by an armor system that includes the energy-dispersion objects. The primary advantage provided by energy-dispersion objects is that the energy associated with an incoming ballistic projectile/ missile is at least partially dispersed toward the perimeter of the layer of energy-dispersion objects, rather than directing all of the energy straight through the layers in a direction perpendicular to the layers and into the vehicle. The dispersing of energy away from the point of impact of the ballistic projectile/missile lowers the pressure applied to the armor at any single point in the armor. In other words, enlarging the area of the energy impact lowers the pressure because the force-per-square-cm or other area is larger than the initial impact area of the ballistic projectile/missile. By spreading the force over a greater area, less damage is done to other layers of the armor and to the vehicle hull itself. FIGS. 5A-5C and 6A-6C illustrate this energy-dispersion concept for embodiments of the present invention that include multiple layers of energy-dispersion objects (for clarity, FIGS. 5A-5C and 6A-6C do not illustrate individual armor unit boundaries (i.e., the boundaries between adjacent lock plates), but in some embodiments, multiple armor units are placed substantially adjacent to each other in order to attain the pattern that is illustrated while, in other embodiments, all of the energy-dispersion objects set forth in a given one of FIGS. 5A-5C and 6A-6C are contained within a single armor unit).

Figure 5B:
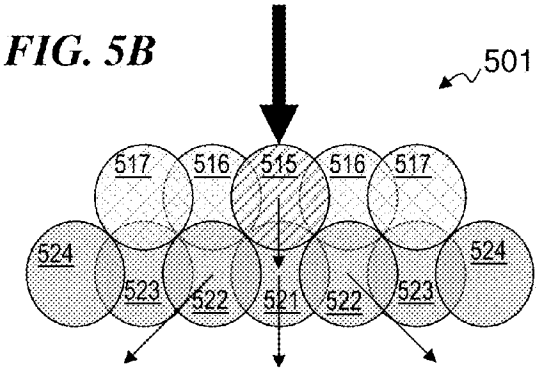
FIG. 5B is a cross-sectional view of FIG. 5A, as viewed along line 501.
Figure 5C:
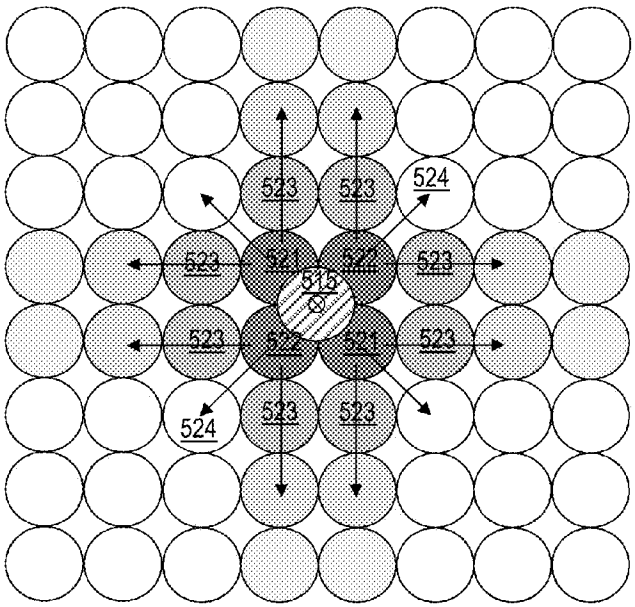
FIG. 5C is a plan view of energy-dispersion objects in an arrangement 502.
Figure 5A:
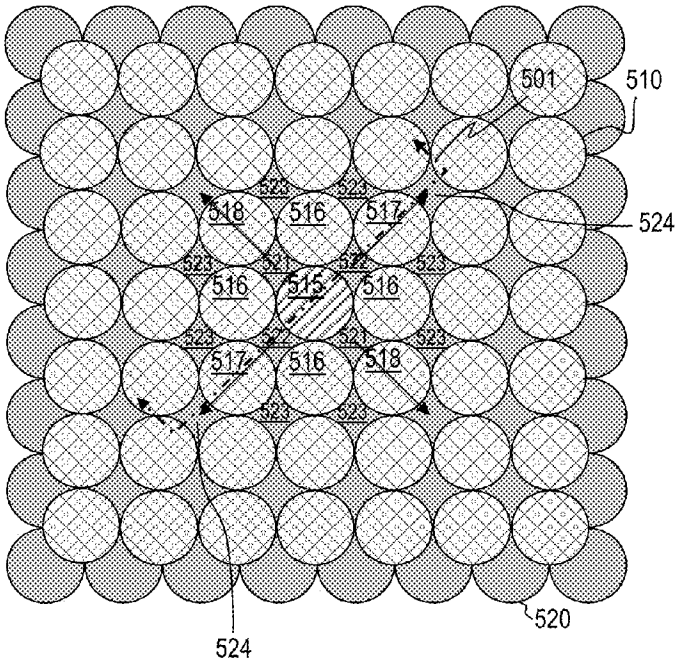
FIG. 5A is a plan view of two layers of spherical energy-dispersion objects arranged in a square-packed configuration 500.

FIG. 5A is a plan view of two layers of spherical energy-dispersion objects arranged in a square-packed configuration 500. As explained above, the objects in a square-packed layer touch or nearly touch four other objects in the same layer. In addition to the square-packed configuration within a given layer, in some embodiments, the two layers are also in a square-packed configuration with respect to each other as illustrated in FIG. 5A. That is, each sphere in top layer 510 contacts or nearly contacts four other spheres in bottom layer 520.

For each spherical energy-dispersion object in top layer 510 (e.g., sphere 515) that is struck by an incoming ballistic projectile/missile, four spherical energy-dispersion objects (e.g., spheres 521 and 522) in bottom layer 520 are struck by the spherical energy-dispersion object, and these energy-dispersion objects in bottom layer 520 are struck at glancing angles, which transfers much of the original energy from the ballistic projectile/missile to energy-dispersion objects traveling in directions having a substantial velocity component perpendicular to the direction of the ballistic projectile/missile and parallel to layers 510 and 520. This sideways travel of several energy-dispersion objects both spreads the impact over a larger area and/or redirects the momentum/energy of the ballistic projectile/missile in directions other than directly inward to the volume being protected (e.g., the crew compartment and/or engine compartment). The energy transferred to the spherical energy-dispersion objects also reduces the speed of the ballistic projectile/missile, allowing the other layers and different materials to stop the slower-moving debris more readily than could be done to the full-speed ballistic projectile/missile.

In contrast to the present embodiment of multiple layers of energy-dispersion objects, if a high-speed incoming copper ballistic projectile from an EFP strikes a solid steel plate while traveling at, e.g., 1000 to 3000 meters per second, it may pass through even a fairly thick plate (e.g., 152-mm to 254-mm (or more) thick) since the steel to the side of the entry point is not readily moved to the sides of the direction of travel. Unlike a solid steel armor plate that does not readily move sideways from the incoming ballistic projectile, the energy-dispersion objects relatively readily move to the side when struck at high velocity (even when embedded in fiber-reinforced polymer), thus transferring much of the energy from a direction of the ballistic projectile (e.g., perpendicular to layers 510 and 520) into directions having a substantial component parallel to layers 510 and 520.

FIG. 5B is a cross-sectional view of FIG. 5A, as viewed along line 501. FIG. 5B illustrates how the energy absorbed by sphere 515 causes the spheres below it (spheres 522 and 521) to move away at an angle, rather than going straight down to the next layer. For example, when a ballistic projectile/missile hits the center of sphere 515 at an angle perpendicular to top layer 510, spheres 521 and 522 move down and away from sphere 515 at an approximately forty-five degree angle (the arrow representing sphere 521's pathway actually comes out of the page toward the viewer at an approximately forty-five degree angle).

FIG. 5C is a plan view of energy-dispersion objects in an arrangement 502. As illustrated by arrangement 502, each individual layer of energy-dispersion objects also provides energy dissipation. For example, as spheres 521 and 522 move away from sphere 515, they transfer some of their energy to the spheres in contact (or nearly in contact) with them in bottom layer 520 (e.g., some of the energy absorbed by spheres 521 and 522 is transferred to spheres 523 in an outward direction parallel to the plane of layer 520 as illustrated in FIG. 5C). The energy transfer from spheres 521 and 522 to spheres 523 causes spheres 523 to move in an outward direction parallel to the plane of layer 520 regardless of the angle in which spheres 521 and 522 are struck by sphere 515 because spheres 521 and 522 are in the same plane as spheres 523. In addition, however, the square-packed configuration of FIG. 5C causes the energy-transfer to spheres 523 and beyond to occur in the cross-like pattern illustrated by FIG. 5C (i.e., spheres 524 receive a minimal amount of energy unless sphere 515 is struck with such force that spheres 522 continue past spheres 523 and into spheres 524).

Returning to FIG. 5A, sphere 515 also transfers some of its energy to the spheres in contact (or nearly in contact) with it in top layer 510 if the ballistic projectile/missile strikes sphere 515 in an off-center location of sphere 515 and/or at some angle other than directly perpendicular, Therefore, in some scenarios, some of the energy absorbed by sphere 515 is transferred to spheres 516 (and to a minimal extent, spheres 518 and 517).

Figure 6B:
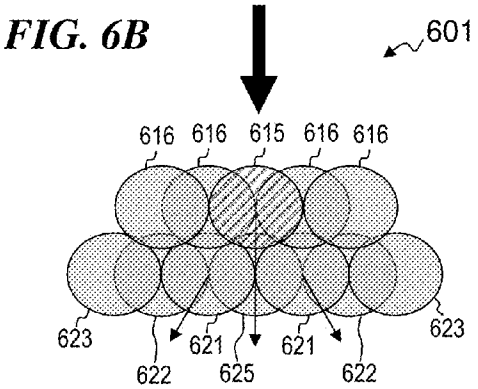
FIG. 6B is a cross-sectional view of FIG. 6A, as viewed along line 601.
Figure 6C:
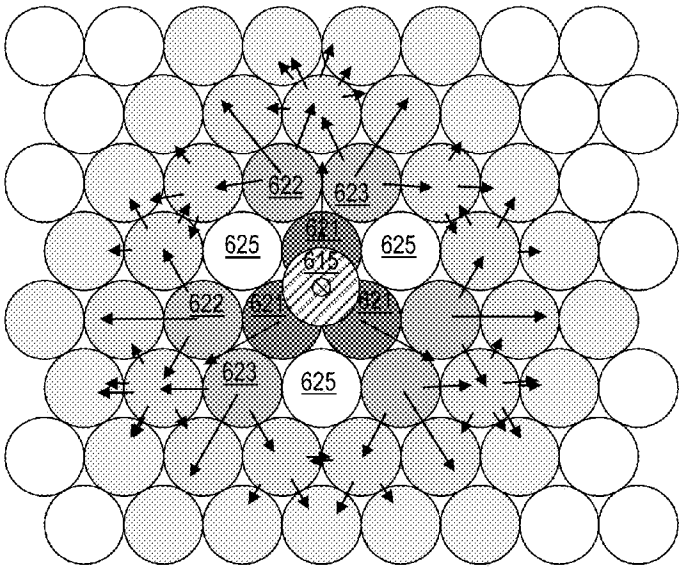
FIG. 6C is a plan view of energy-dispersion objects in an arrangement 602.
Figure 6A:
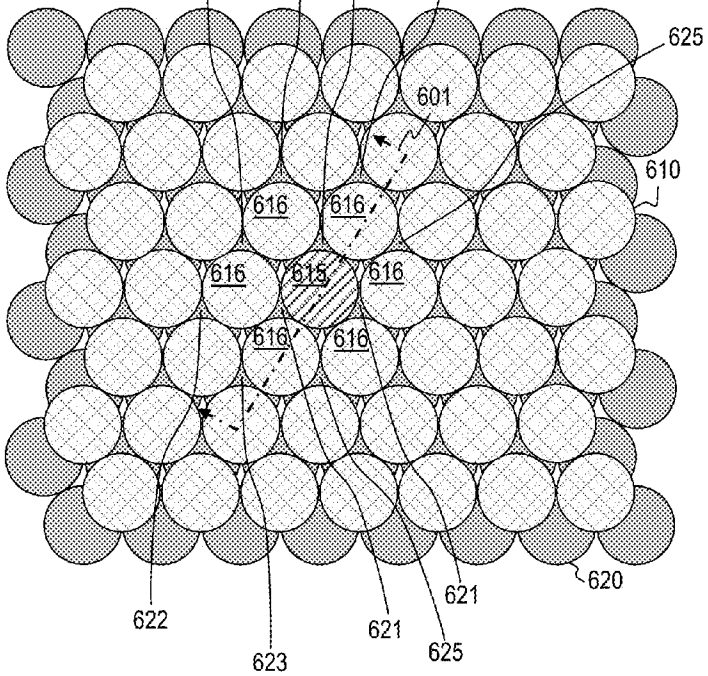
FIG. 6A is a plan view of two layers of spherical energy-dispersion objects, wherein each layer is arranged in a hexagonal-packed configuration 600.

FIG. 6A is a plan view of two layers of spherical energy-dispersion objects, wherein each layer is arranged in a hexagonal-packed configuration 600. As explained above, the objects in a hexagonal-packed layer touch (or nearly touch) six other objects in the same layer. In addition to the hexagonal-packed configuration within a given layer, the two layers are also in a hexagonal-packed configuration with respect to each other. That is, each sphere in top layer 610 contacts (or nearly contacts) three other spheres in bottom layer 620. As can be seen by comparing FIG. 5B to FIG. 6B, a hexagonal-packed layer of energy-dispersion objects is more dense and therefore heavier than a square-packed layer, and a hexagonal-packed layer provides less angle of deflection (compared to a vertical line) from one layer to an adjacent layer (e.g., approximately thirty degrees for a hexagonal-packed layer and approximately forty-five degrees for a square-packed layer). A given layer of hexagonal-packed energy-dispersion objects, however, disperses energy from a ballistic projectile/missile among significantly more energy-dispersion objects than the number of energy-dispersion objects affected in a given layer of square-packed energy-dispersion objects (see FIG. 5C versus FIG. 6C).

FIG. 6B is a cross-sectional view of FIG. 6A, as viewed along line 601. FIG. 6B illustrates how the energy absorbed by sphere 615 causes the spheres below it (spheres 621) to move away at an angle, rather than going straight down to the next layer. For example, when a ballistic projectile/missile hits the center of sphere 615 at an angle perpendicular to top layer 610, spheres 621 move down and away from sphere 615 at an approximately thirty-degree angle (compared to a vertical line running through the middle of sphere 615).

FIG. 6C is a plan view of energy-dispersion objects in an arrangement 602. As illustrated by arrangement 602, each individual layer of energy-dispersion objects also provides energy dissipation. For example, as spheres 621 move away from sphere 615, they transfer some of their energy to the spheres in contact (or nearly in contact) with them in bottom layer 620 (e.g., some of the energy absorbed by spheres 621 is transferred to spheres 622 and 623 in an outward direction parallel to the plane of layer 620 as illustrated in FIG. 6C). The energy transfer from spheres 621 to spheres 622 and 623 causes spheres 622 and 623 to move in an outward direction parallel to the plane of layer 620 regardless of the angle in which spheres 621 are struck by sphere 615 because spheres 621 are in the same plane as spheres 622 and 623. In addition, due to the hexagonal-packed configuration of FIG. 6C (which is more closely packed than the square-packed configuration of FIG. 5C), virtually all of the spheres in layer 620 absorb some of the energy from spheres 621 (as illustrated in FIG. 6C, the only spheres that receive minimal energy transfer are spheres 625). Therefore, although a hexagonal-packed configuration adds more weight to a multi-layer composite armor than a square-packed configuration, a hexagonal configuration also provides more energy-dispersion than the square configuration.

Returning to FIG. 6A, sphere 615 also transfers some of its energy to the spheres in contact (or nearly in contact) with it in top layer 610 if the ballistic projectile/missile strikes sphere 615 in an off-center location of sphere 615 and/or at some angle other than directly perpendicular. Therefore, in some scenarios, some of the energy absorbed by sphere 615 is transferred to spheres 616 and beyond.

Figure 7B:
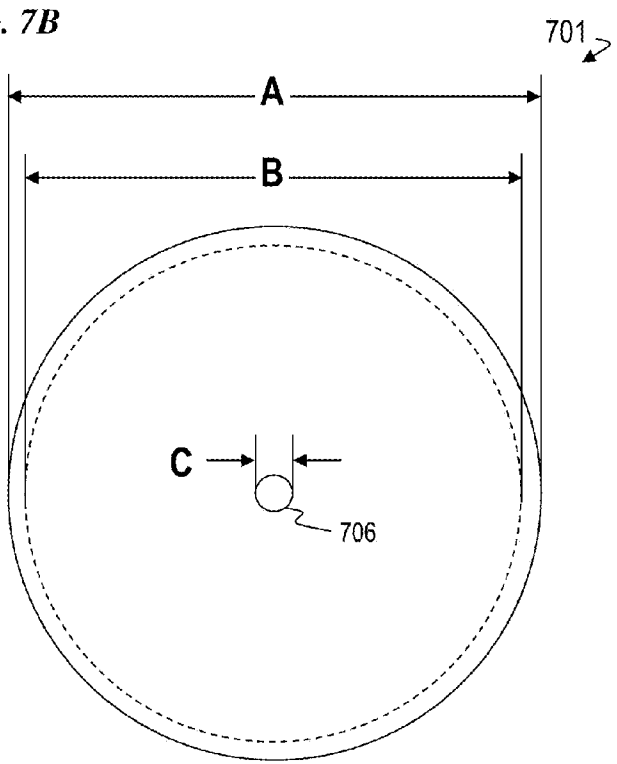
FIG. 7B is a schematic drawing of energy-dispersion object 701.
Figure 7A:
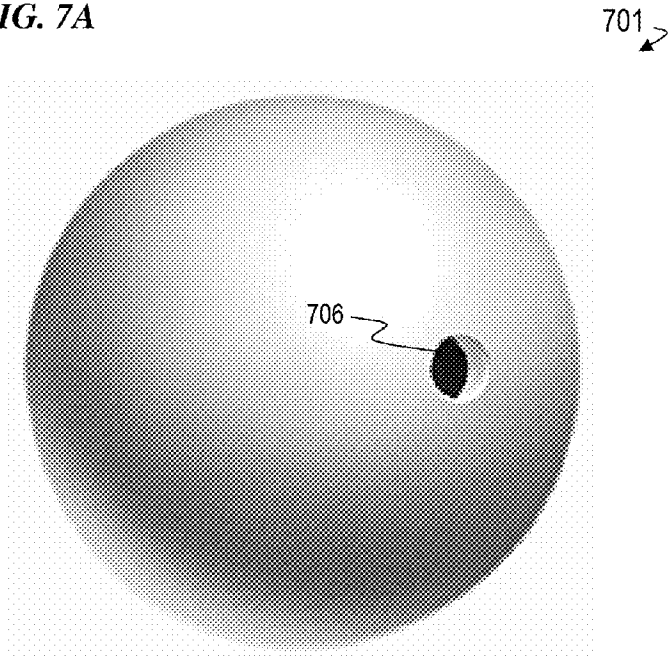
FIG. 7A is a perspective view of an energy-dispersion object 701.

FIG. 7A is a perspective view of an energy-dispersion object 701. In some embodiments, energy-dispersion object 701 is one of a plurality of energy-dispersion objects 701 configured for use in the armor units/systems described for the present invention (e.g., armor unit 201 of FIG. 2A). In some embodiments, energy-dispersion object 701 has a shape configured to deflect ballistic energy. In some such embodiments, energy-dispersion object 701 is a hardened-shell hollow sphere or other suitable hardened-shell hollow shape (e.g., an ovoid, a cylinder, a cube, or the like). In some embodiments, energy-dispersion object 701 is made from a material that includes a metal or metal alloy. For example, in some embodiments, energy-dispersion object 701 is made from a material that includes 4330-type steel. In some embodiments, energy-dispersion object 701 is made from a material that includes 1010-type steel, 1018-type steel, 1020-type steel, 1025-type steel, 1030-type steel, 4130-type steel, armor-grade steels (e.g., steels produced to military standards MIL-DTL-12560), or the like. In some embodiments, energy-dispersion object 701 is made from a composite material such as carbon fiber or the like. In some embodiments, energy-dispersion object 701 is made a material that includes a ceramic. In some embodiments, energy-dispersion object 701 is a ceramic-coated steel sphere.

In some embodiments, energy-dispersion object 701 includes an injection hole 706 through which a glass-filled nylon or other suitable material is injected into energy-dispersion object 701. In some embodiments, energy-dispersion object 701 is injected with a glass-filled nylon such as 30% glass fiber nylon-6 (e.g., LGF30-PA6 1001 NAT glass-filled nylon from a supplier such as PlastiComp LLC, 110 Galewski Drive, Winona Minn. 55987). In some embodiments, 30% glass-filled nylon has physical properties approaching the strength of aluminum and has a weight of about one-third the weight of aluminum. In some embodiments, the glass fiber in the glass-filled nylon material includes an E-glass, an S-glass, or any other suitable glass type. In some embodiments, energy-dispersion object 701 is injected with a basalt-fiber reinforced nylon. In some embodiments, energy-dispersion object 701 is injected with an unhardened polymeric or other composite of materials. For example, in some embodiments, energy-dispersion object 701 is injected with deadened non-rebounding polyurethane (e.g., viscoelastic polyurethane such as provided by U.S. Pat. No. 7,238,730, titled "VISCOELASTIC POYURETHANE FOAM", issued Jul. 3, 2007). In some embodiments, energy-dispersion object 701 is injected with a high-tensile-strength polyurethane such as obtained using Andur 5 DPLM-brand prepolymer provided by Anderson Development Corporation (www.andersondevelopment-.com/surv_bin.php?x={486D54-005531-7D34C9}&y=1). As used herein, armored polyurethane (AP) is defined as energy-dispersion objects 701 that are filled with a polyurethane such as a polyester-based polyurethane available from, e.g., Anderson Development (www.andersondevelopment-.com).

In some embodiments, energy-dispersion object 701 undergoes one or more anti-ballistic treatments after being filled with glass-filled nylon to further harden and/or strengthen energy-dispersion object 701. For example, in some embodiments, a heat treatment is applied to energy-dispersion object 701 to normalize any welds present on energy-dispersion object 701 (as described below, in some embodiments, energy-dispersion objects are produced by welding together to hollow-sphere halves of the desired material). In some embodiments, a case-hardening process is applied to energy-dispersion object 701. Example case-hardening processes include carbonitriding, FNC (i.e., ferritic nitrocarburizing, such as the DYNA-BLUE® process provided by Dynamic Surface Technologies, www.dynablue.com), and carburizing. In some embodiments, a tool-coat process is applied to energy-dispersion object 701 (e.g., a BALINIT® tool coating provided by Oerlikon-Balzer). In some embodiments, any other suitable anti-ballistic treatment or combination of anti-ballistic treatments is applied to energy-dispersion object 701.

In some embodiments, treating energy-dispersion object 701 with both a FNC (which hardens the surface of energy-dispersion object 701) and a tool coat like BALINIT® (which makes the surface of energy-dispersion object 701 wear resistant and slippery) is especially suitable for smaller-diameter energy-dispersion objects 701 designed to protect against extremely high-velocity smaller-diameter ballistic projectiles/missiles. In some embodiments, energy-dispersion object 701 is carbonitrided and FNC-treated (in some such embodiments, energy-dispersion object is made from 4330 steel). In some embodiments, energy-dispersion object 701 is carbonitrided and tool-coated. In some embodiments, energy-dispersion object is treated with a diamond-coated composite such as provided by Surface Technology, Inc. (www.surfacetechnology.com/cdc.html). In some embodiments, a quench-and-temper process is applied to energy-dispersion object 701. In some embodiments, a quench-and-temper process and a carburizing process are applied to energy-dispersion object 701. In some embodiments, a quench-and-temper process and a carbonitriding process are applied to energy-dispersion object 701. In some embodiments, a quench-and-temper process and a FNC-process (e.g., DYNA-BLUE®) are applied to energy-dispersion object 701. In some embodiments, energy-dispersion object 701 undergoes any other suitable anti-ballistic treatment or combination of anti-ballistic treatments.

In some embodiments, the anti-ballistic treatments are applied to energy-dispersion object 701 in order to obtain a desired hardness (e.g., as measured by Rockwell "C" Hardness, Vickers microhardness, or the like). As used herein, Rockwell "C" Hardness is defined as a designation of hardness, usually of steel or Corrosion Resistant Alloys, measured by pressing a specially shaped indenter against a clean prepared surface with a specific force. The machine making the indention also measures the depth of the indention and provides a numerical value for that depth. As used herein, "Vickers microhardness" is defined as a method of determining the hardness of steel whereby a diamond pyramid is pressed into the polished surface of the specimen and the diagonals of the impression are measured with a microscope fitted with a micrometer eye piece. The rate of application and duration are automatically controlled and the load can be varied. In some embodiments, energy-dispersion object 701 is made from 4330 steel and has a Rockwell "C" Hardness (HRC) value of 30 after the desired anti-ballistic treatment is applied. In some embodiments, energy-dispersion object 701 has an HRC value of 35 after the desired anti-ballistic treatment is applied. In some embodiments, energy-dispersion object 701 has an HRC value of 40 after the desired anti-ballistic treatment is applied. In some embodiments, energy-dispersion object 701 has any other suitable HRC value. In some embodiments, energy-dispersion object 701 has a Vickers microhardness (Vickers) value in a range of between about 42 and 59 after the desired anti-ballistic treatment is applied. In some embodiments, energy-dispersion object 701 has a Vickers value in a range of between about 43 and 51 after the desired anti-ballistic treatment is applied. In some embodiments, energy-dispersion object 701 has a Vickers value in a range of between about 39 and 58 after the desired anti-ballistic treatment is applied. In some embodiments, energy-dispersion object 701 has any other suitable Vickers value/range of values.

FIG. 7B is a schematic drawing of energy-dispersion object 701. Measurement A is the outer diameter (O.D.) of energy-dispersion object 701. Measurement B is the inner diameter (I.D.) of energy-dispersion object 701. Measurement C is the diameter of injection hole 706. In some embodiments, measurement C is about 6.35 mm (¼-inch). In some embodiments, measurements A and B of energy-dispersion object 701 are tailored to corresponding weapon threats. In some embodiments, measurement A is about 101.6 mm (4 inches) and measurement C is about 95.25 mm (3¾ inches) such that energy-dispersion object 701 has a thickness of about 3.175 mm (⅛ inch).

In some embodiments, energy-dispersion object 701 has a thickness of about 0.80 mm (1/32 inch), of about 1.60 mm (1/16 inch), of about 6.35 mm (¼ inch), or of greater than about 6.35 mm (¼ inch).

In some embodiments, energy-dispersion object 701 has an O.D. of about 89 mm (3½ inches), of about 76 mm (3 inches), of about 64 mm (2½ inches), of about 51 mm (2 inches), of about 38 mm (1½ inches), of about 25 mm (1 inch), of about 13 mm (½ inch), or of less than about 13 mm such as about 12 mm, about 11 mm, about 10 mm, about 9 mm, about 8 mm, about 7 mm, about 6 mm, about 5 mm, or less than about 5 mm. In some embodiments, energy-dispersion objects 701 with small O.D.'s (e.g., less than about 13 mm (½ inch) are configured to protect against RPG's, long-rod penetrators, Sabot-dart anti-tank rounds, or the like. In some embodiments, energy-dispersion object 701 has an O.D. of greater than about 102 mm (4 inches) such as about 127 mm (5 inches), of about 254 mm (10 inches), of about 635 mm (25 inches), or of greater than about 635 mm. In some embodiments, energy-dispersion objects 701 used in multiple different layers have the same size (e.g., in some embodiments, all of the energy-dispersion objects 701 in each layer of an armor system have the same O.D.). In other embodiments, energy-dispersion objects 701 have a first size in a first layer and a second size in a second layer (see, e.g., FIG. 9B).

Figures 8A, 8B:
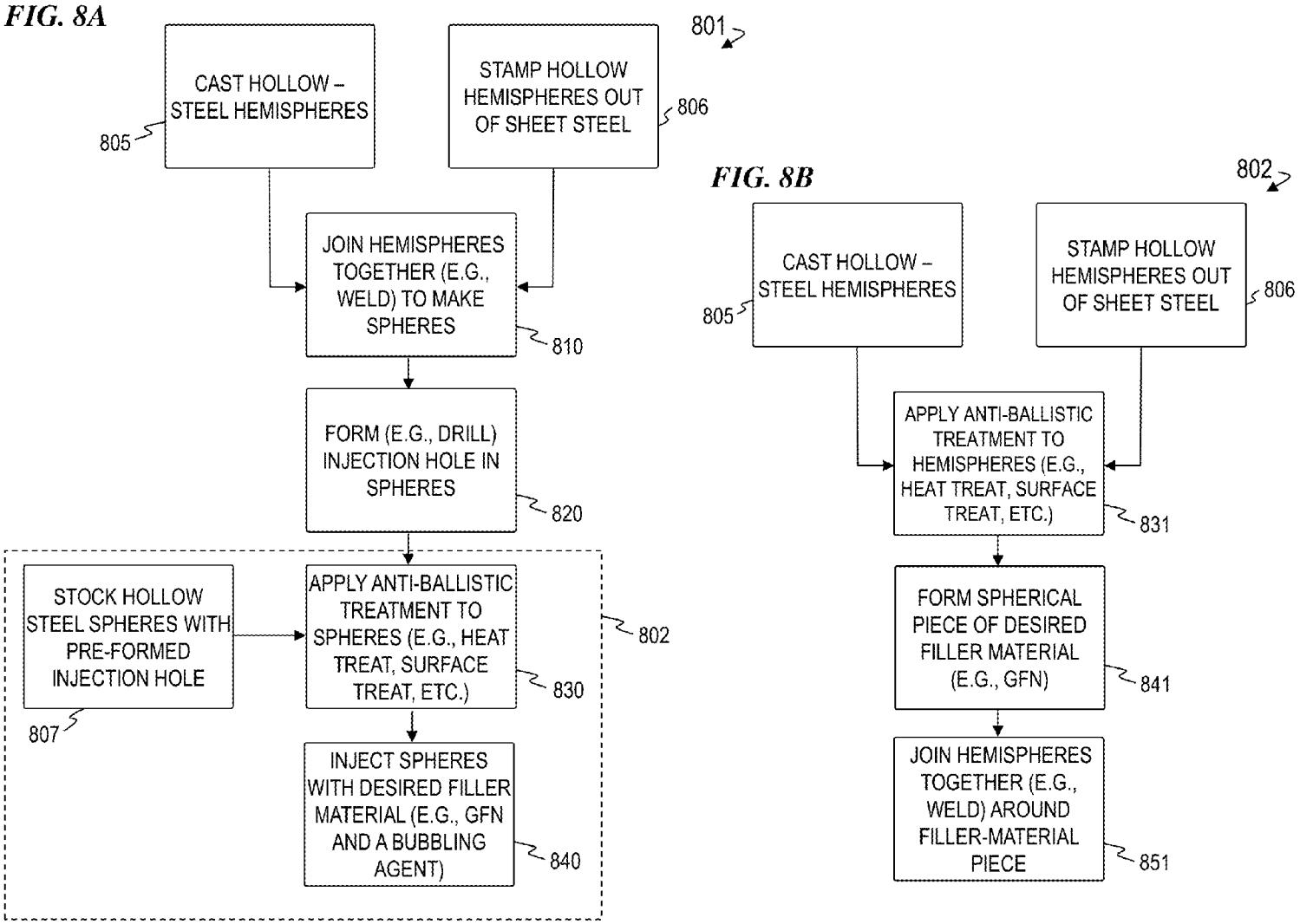
FIG. 8A is a flow diagram of a method 801 for manufacturing energy-dispersion objects.
FIG. 8B is a flow diagram of a method 802 for manufacturing energy-dispersion objects.

FIG. 8A is a flow diagram of a method 801 for manufacturing energy-dispersion objects. The energy-dispersion objects created by method 801 can be used in any of the embodiments described by the present invention. In some embodiments, method 801 starts by producing hollow hemispheres. In some embodiments, hollow hemispheres are created by casting steel hollow hemispheres (block 805). In other embodiments, hollow hemispheres are created by stamping the hollow hemispheres out of sheet steel (block 806).

In some embodiments, the hollow hemispheres produced at block 805 and/or block 806 are then joined together to make spheres at block 810. In some embodiments, the hemispheres are welded together using a spin-weld process (where the hemispheres are spun together at a high RPM) such as provided by Spinweld, Inc. (www.spinweld.com/friction-welding-process.php). In some embodiments, the hemispheres are welded together using a robotic-laser-weld process such as provided by RobotWorx (www.welding-robots.com/applications.php?app=laser+welding). In other embodiments, the hemispheres are joined together to form spheres using any other suitable method. In some embodiments, the completed spheres serve as the mold or form for their own injection process (see block 840).

In some embodiments, after forming the spheres, an injection hole is formed in each sphere at block 820 (in some such embodiments, the injection hole is drilled out of each sphere) such that each sphere can be injected with a desired filler material (in some embodiments, completed energy-dispersion objects are placed in the desired armor system such that the injection hole faces away from the strike-face side of the armor system).

In some embodiments, the spheres are treated with an anti-ballistic treatment at block 830 to increase core material and surface strength. For example, in some embodiments, spheres are heat treated and surface treated (e.g., in some embodiments, spheres are quench-and-tempered, carbonitrided, and treated with a BALINIT® tool coating provided by Oerlikon-Balzer).

In some embodiments, spheres are injected with the desired filler material (e.g., glass-filled nylon and a bubbling agent) at block 840 to form the completed energy-dispersion objects. In some embodiments, a bubbling agent is added during the injection process to ensure consistent pressure and uniformity of contact with the "armored" wall of the outer structure of the sphere. This serves to greatly support the outer structure of the sphere and also helps contain fragments that are strong enough to penetrate the outer structure of the sphere when the sphere is struck by a ballistic projectile or missile. In some embodiments, the bubbling agent is Hydrocerol XH-901 such as provided by Clariant Masterbatches (www.masterbatches.com/bu/mb/internet.nsf/023cfbb98594ad5bc12564e400555162/ b6a3181666a1 d88dc12579aa001e6363?OpenDocument). In some embodiments, tooling (e.g., a clamp-like structure) is used to hold the sphere in place during the injection process.

In some embodiments, blocks 805-820 are eliminated from method 801 and a sub-method 802 is performed instead. In some such embodiments, stock hardened-shell hollow spheres made of the desired metal or metal alloy (e.g., 1018 steel) are purchased off the shelf from suppliers such as Sharpe Products (www.sharpeproducts.com/architectural_pipe_tube_handrail_fittings.html) at block 807. In some embodiments, the stock hollow spheres include a pre-formed injection hole. In some embodiments, the stock hollow spheres are treated at block 830 and injected at block 840 to form the completed energy-dispersion objects.

FIG. 8B is a flow diagram of a method 802 for manufacturing energy-dispersion objects. In some embodiments, instead of injecting spheres with the desired filler material to form energy-dispersion objects (e.g., block 840 of FIG. 8A), the hemispheres produced at block 805 and/or block 806 are joined together around a filler material in order to form completed energy-dispersion objects that do not have an injection hole. In some such embodiments, the hemispheres created at block 805 and/or block 806 are treated with an anti-ballistic treatment at block 831, a spherical piece of the desired filler material (e.g., glass-filled nylon) is formed at block 841, and the hemispheres are joined together around the filler-material piece at block 851 to make the completed energy-dispersion objects. In some embodiments, block 851 includes joining the hollow hemispheres together around the spherical filler-material piece (e.g., welding the hemispheres together, melting the hemispheres onto the filler-material piece, or the like) such that the filler material has uniform contact with the inner walls of the formed energy-dispersion object. In some embodiments, desired filler material is placed into the hollow hemispheres and then the filled hemispheres are joined together to form the completed energy-dispersion objects.

Additional Armor Embodiments

Figures 2, 9A:
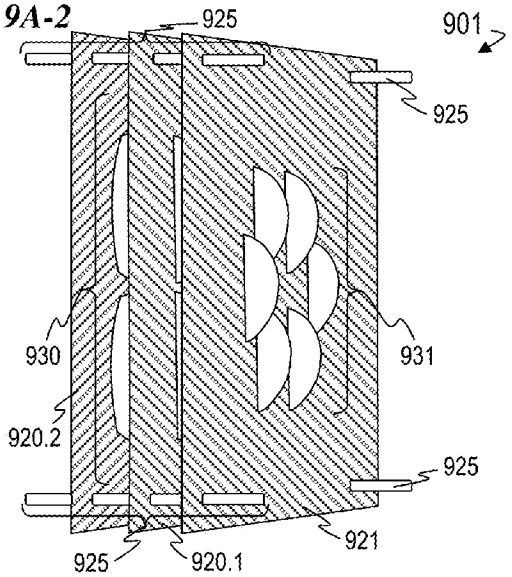
Figure 9C:
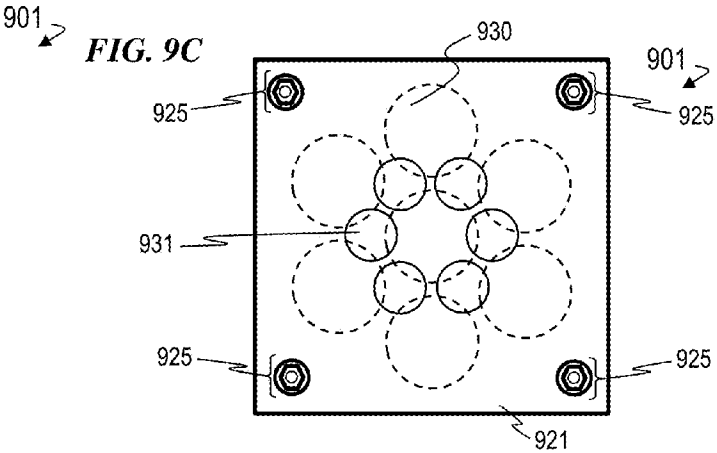
FIG. 9C is a front view of armor unit 901.
Figures 1, 9A:
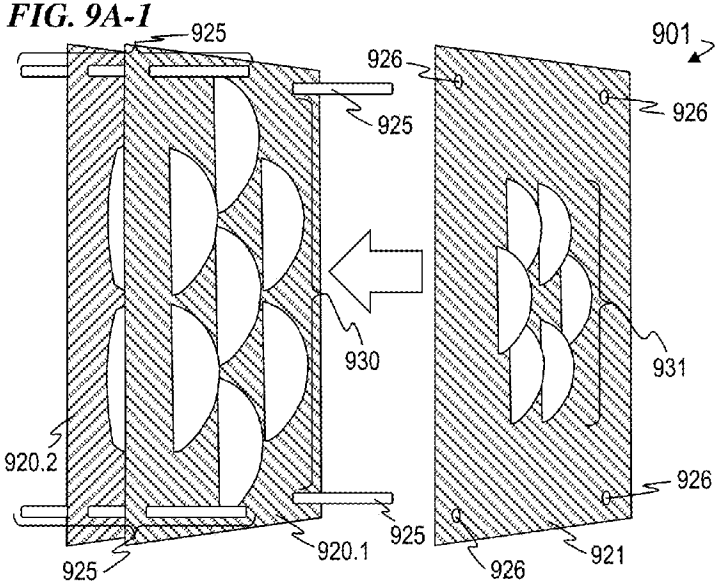
FIG. 9A-1 is a perspective view of a multi-layer hexagonal-packed armor unit 901 prior to complete assembly.

FIG. 9A-1 is a perspective view of a multi-layer hexagonal-packed armor unit 901 prior to complete assembly. In some embodiments, armor unit 901 is one of a plurality of individual armor units 901 that are affixed to an area of a vehicle to protect that area of the vehicle from ballistic projectiles and/or missiles. In some embodiments, armor unit 901 includes a first plurality of energy-dispersion objects 930 held in place in the hexagonal-packed configuration by lock plates 920 (a first lock plate 920.1 and a second lock plate 920.2) and fastener sets 925. In some embodiments, armor unit 901 is substantially similar to armor unit 201 of FIG. 2A except that armor unit 901 includes an additional layer of energy-dispersion objects 931 that have a smaller diameter than the energy-dispersion objects 930. In some embodiments, energy-dispersion objects 931 are used to fill in the gaps between individual energy-dispersion objects 930. In some embodiments, each individual energy-dispersion object 930 has a diameter that is about 102 mm (4 inches) and each individual energy-dispersion object 931 has a diameter that is about 51 mm (2 inches). In some embodiments, the layer of energy-dispersion objects 931 are contained within lock plate 921, which includes fastener holes 926 configured to receive the fastener sets 925. In some embodiments, lock plates 920 and 921 and energy-dispersion objects 930 and 931 are assembled into complete armor unit 901 by sliding holes 926 of lock plate 921 over fastener sets 925 and tightening (e.g., tightening a bolt/washer/nut combination that forms each fastener set 925). In some embodiments, energy-dispersion objects 931 and lock plate 921 are on the strike-face side of armor unit 901.

FIG. 9A-2 is a perspective view of multi-layer armor unit 901 after complete assembly. In some embodiments, instead of using a single lock plate 921 to hold energy-dispersion objects 931 in place, two lock plates are used. In some embodiments, armor unit 901 includes more than two layers of energy-dispersion objects. In some embodiments, energy-dispersion objects 931 are the same size (e.g., same diameter) as energy-dispersion objects 930.

Figure 9B:
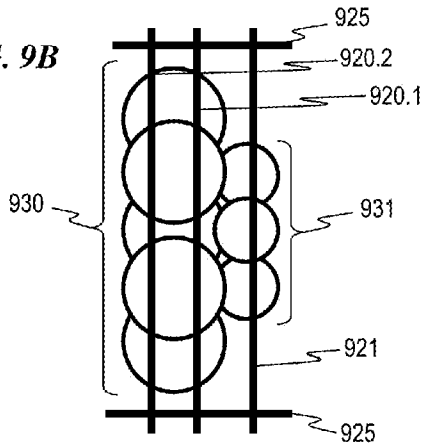
FIG. 9B is a side view of armor unit 901.

FIG. 9B is a side view of armor unit 901.

FIG. 9C is a front view of armor unit 901.

Figures 2, 10A:
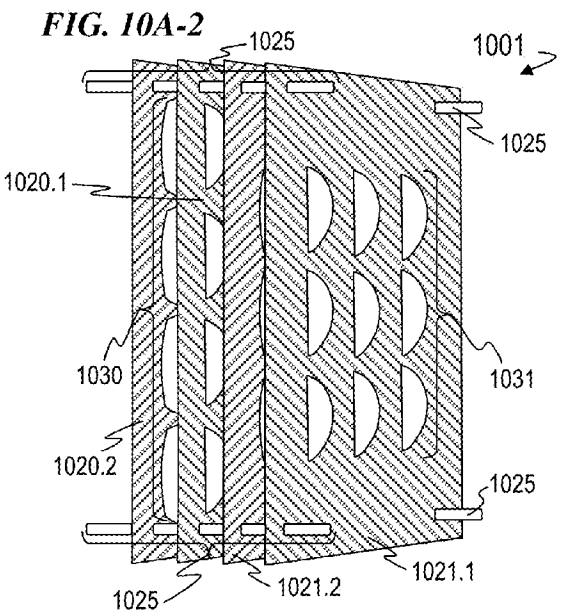

FIG. 10A-1 is a perspective view of a multi-layer square-packed armor unit 1001 prior to complete assembly. In some embodiments, armor unit 1001 is one of a plurality of individual armor units 1001 that are affixed to an area of a vehicle to protect that area of the vehicle from ballistic projectiles and/or missiles. In some embodiments, armor unit 1001 includes a first plurality of energy-dispersion objects 1030 held in place in the square-packed configuration by lock plates 1020 (a first lock plate 1020.1 and a second lock plate 1020.2) and fastener sets 1025. In some embodiments, armor unit 1001 is substantially similar to armor unit 301 of FIG. 3A except that armor unit 1001 includes an additional layer of energy-dispersion objects 1031 that are used to fill in the gaps between individual energy-dispersion objects 1030. In some embodiments, each individual energy-dispersion object 1030 and 1031 has a diameter that is about 102 mm (4 inches). In some embodiments, the layer of energy-dispersion objects 1031 are contained within two lock plates 1021 (a first lock plate 1021.1 and a second lock plate 1021.2) and each lock plate 1021 includes fastener holes 1026 configured to receive the fastener sets 1025. In some embodiments, lock plates 1020 and 1021 and energy-dispersion objects 1030 and 1031 are assembled into complete armor unit 1001 by sliding holes 1026 of lock plates 1021 over fastener sets 1025 and tightening (e.g., tightening a bolt/washer/nut combination that forms each fastener set 1025). In some embodiments, energy-dispersion objects 1031 and lock plates 1021 are on the strike-face side of armor unit 1001.

FIG. 10A-2 is a perspective view of multi-layer armor unit 1001 after complete assembly. In some embodiments, instead of using a two lock plates 1021 to hold energy-dispersion objects 1031 in place, a single lock plate is used. In some embodiments, armor unit 1001 includes more than two layers of energy-dispersion objects. In some embodiments, energy-dispersion objects 1031 have a different size (e.g., diameter) than energy-dispersion objects 1030. In some embodiments, energy-dispersion objects 1030 and 1031 are not filled with anything and thus are hollow spheres (e.g., in some embodiments, energy-dispersion objects 1030 and 1031 are hollow 4330 steel spheres that undergo anti-ballistic treatments (e.g., a heat treatment and a surface treatment)).

Figure 10C:
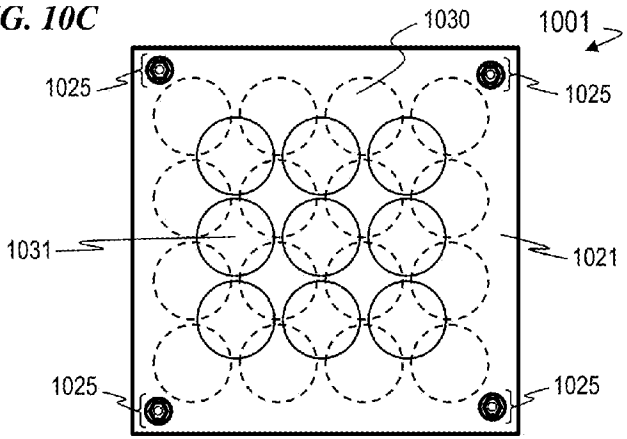
FIG. 10C is a front view of armor unit 1001.
Figures 1, 10A:
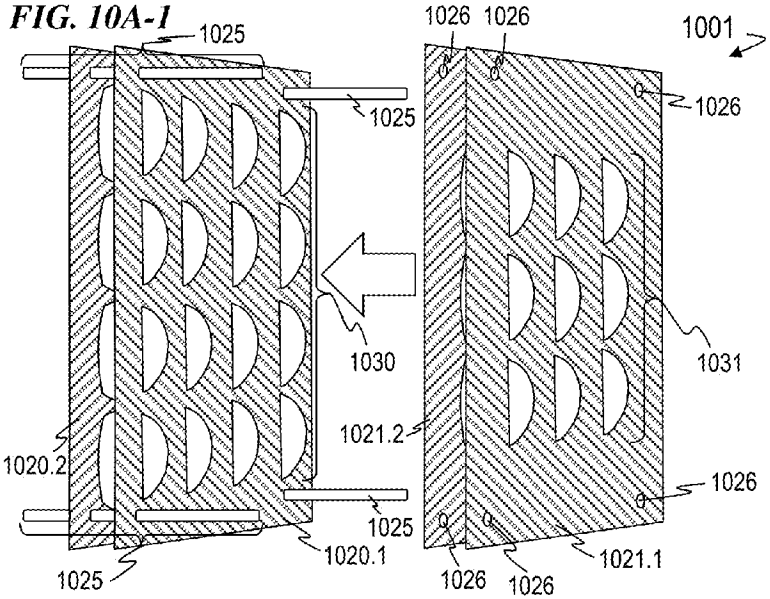
Figure 10B:
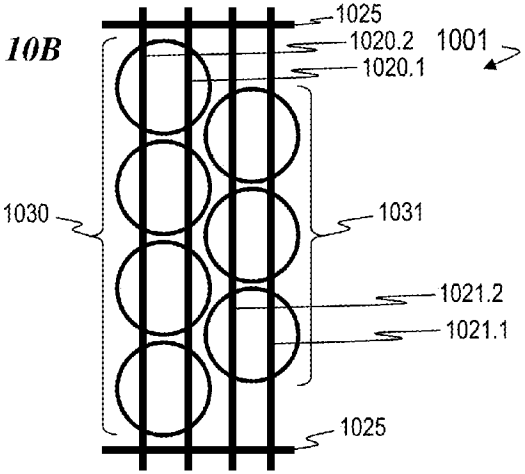
FIG. 10B is a side view of armor unit 1001.

FIG. 10B is a side view of armor unit 1001.

FIG. 10C is a front view of armor unit 1001.

Figure 11B:
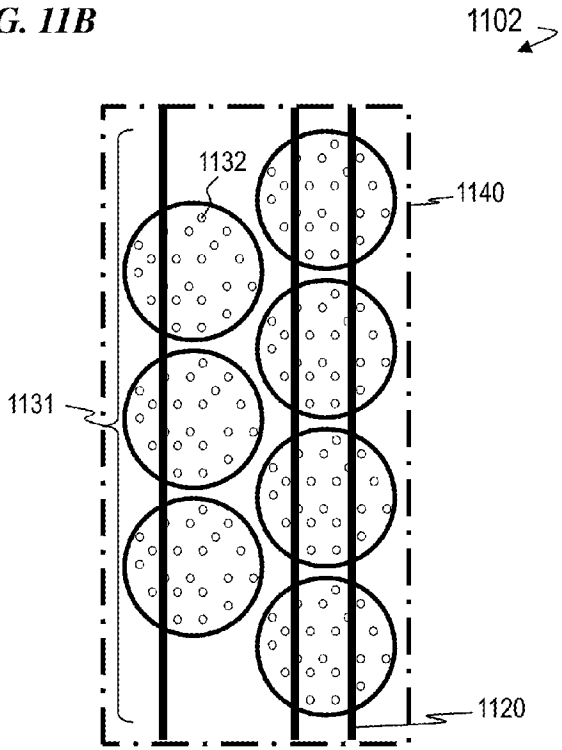
FIG. 11B is a side view of an armor unit 1102.
Figure 11A:
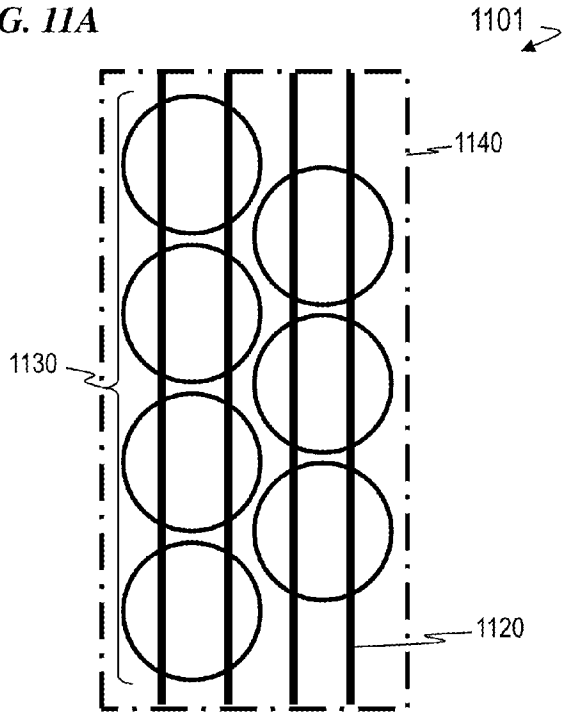
FIG. 11A is a side view of an armor unit 1101.

FIG. 11A is a side view of an armor unit 1101. In some embodiments, armor unit 1101 includes a plurality of energy-dispersion objects 1130 (e.g., heat treated and case hardened AFGN energy-dispersion objects) arranged in a square-packed configuration (in some embodiments, the layer of energy-dispersion objects 1130 containing four rows of energy-dispersion objects is on the vehicle side of armor unit 1101). In some embodiments, the plurality of energy-dispersion objects 1130 are held in place by lock plates 1120 (e.g., 1018 steel plates). In some embodiments, lock plates 1120/energy-dispersion objects 1130 are encased within a polymer 1140 (e.g., a high-tensile-strength polyurethane such as obtained using Andur 5 DPLM-brand prepolymer provided by Anderson Development Corporation (www.andersondevelopment.com/surv_bin.php?x={486D54-005531-7D34C9}&y=1)) and thus no fastener sets are needed to hold lock plates 1120 together.

FIG. 11B is a side view of an armor unit 1102. In some embodiments, armor unit 1102 is substantially similar to armor unit 1101 except that energy-dispersion objects 1130.1 replace energy-dispersion objects 1130, three lock plates 1120 are used rather than four, and the layer of energy-dispersion objects 1130.1 containing four rows of energy-dispersion objects is on the strike-face side of armor unit 1102. In some embodiments, instead of glass-filled nylon, energy-dispersion objects 1130.1 are filled with solid steel spheres 1132 having a diameter of about 6.35 mm (¼ inch). In some embodiments, energy-dispersion objects 1130.1 have a diameter of about 76 mm (3 inches). In some embodiments, an air gap of about 76-102 mm (3 to 4 inches) is kept between separate armor units 1102.

Figure 12B:
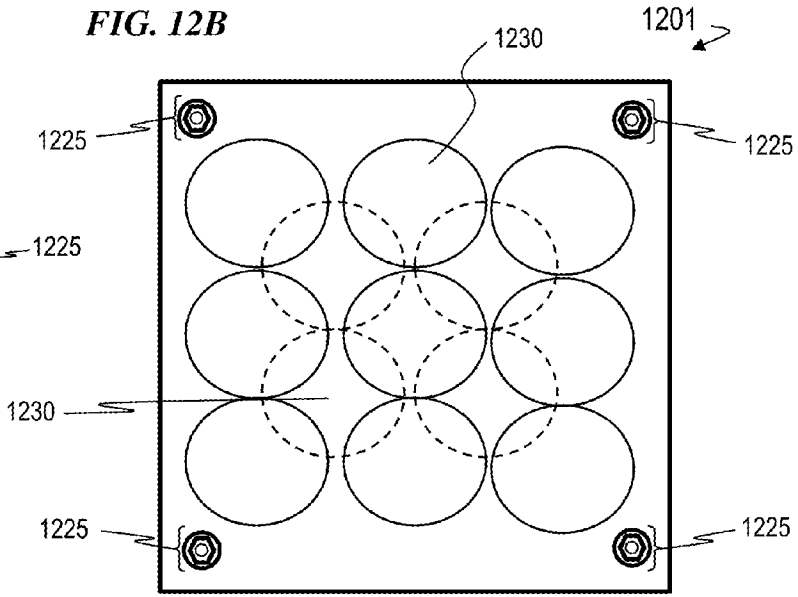
FIG. 12B is a front view of armor unit 1201.
Figure 12A:
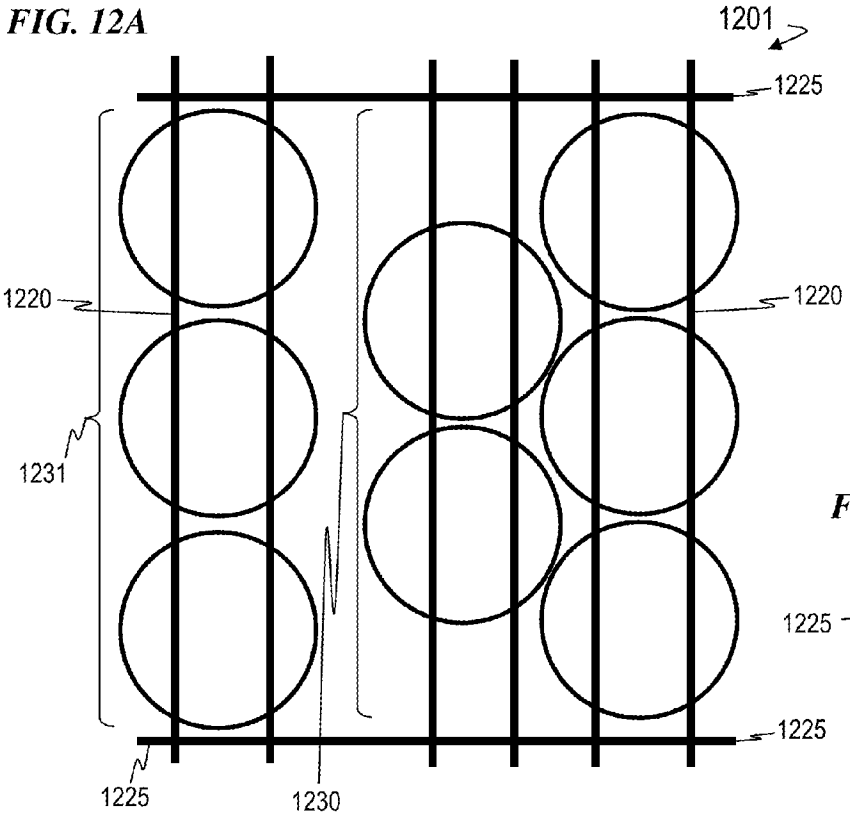
FIG. 12A is a side view of an armor unit 1201.

FIG. 12A is a side view of an armor unit 1201. In some embodiments, armor unit 1201 includes a plurality of energy-dispersion objects 1231 (e.g., hardened-shell hollow 4330 steel spheres that are heat treated and surface treated and that have a diameter of about 102 mm (4 inches)), and a plurality of energy-dispersion objects 1230 (e.g., heat treated and case hardened AGFN spheres made of 4330 steel that have a diameter of about 102 mm (4 inches)). In some embodiments, the plurality of energy-dispersion objects 1230 and 1231 are held in place in a square-configuration with lock plates 1220 (e.g., 1018 steel plates) and fastener sets 1225. In some embodiments, energy-dispersion objects 1231 are on the vehicle side of armor unit 1201.

FIG. 12B is a front view of armor unit 1201. In the front view of FIG. 12B, the hollow energy-dispersion objects 1231 cannot be seen because they are directly behind the outside layer of energy-dispersion objects 1230.

Figure 13:
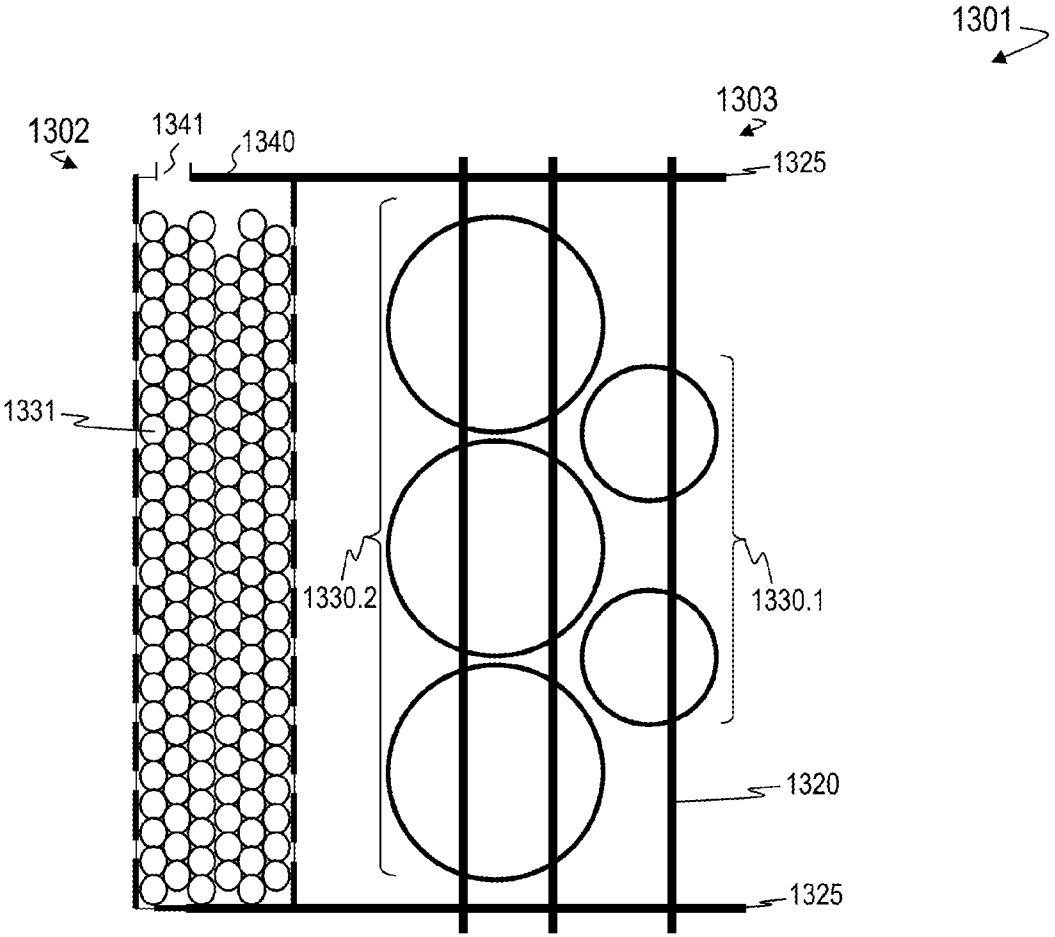
FIG. 13 is a cross-sectional side view of a multi-purpose armor unit 1301.

FIG. 13 is a cross-sectional side view of a multi-purpose armor unit 1301. In some embodiments, armor unit 1301 includes a rear assembly 1302 (vehicle side) and a front assembly 1303 (strike-face side). In some embodiments, rear assembly 1302 includes a plurality of small energy-dispersion objects 1331 (e.g., in some embodiments, energy-dispersion objects 1331 have a diameter of about 13 mm (½ inch)) that are tightly packed within a container 1340. In some embodiments, energy-dispersion objects 1331 fit so tightly into container 1340 that objects 1331 cannot move. In some such embodiments, one or more shims are used to achieve this tight fit. In some embodiments, energy-dispersion objects 1331 are heat treated, case hardened (e.g., the DYNA-BLUE® FNC-process), and/or tool coated (e.g., a BALINIT® tool coating such as provided by Oerlikon-Balzer) to enhance strength, durability, hardness, and wear-resistance of energy-dispersion objects 1331. In some embodiments, an air gap is kept between assembly 1302 and assembly 1303. In some embodiments, container 1340 is made of a metal or a suitable high-strength material (e.g., aluminum, carbon fiber, glass-filled nylon, or the like). In some embodiments, container 1340 is perforated for lighter weight. In some embodiments, container 1340 is connected to a vehicle by bolting container 1340 directly to the vehicle (e.g., with fastener sets 1325 of assembly 1303). In other embodiments, container 1340 is slid into slots on the exterior of the vehicle (see, e.g., vehicle pockets 1580 of FIG. 15). In some embodiments, container 1340 includes a port 1341 for filling the container with the plurality of energy-dispersion objects 1331. In some embodiments, assembly 1303 is substantially similar to armor unit 1001 of FIG. 10A-2 except that, in some embodiments, assembly 1303 has energy-dispersion objects 1330 in layers of two rows (energy-dispersion objects 1330.1) and three rows (energy-dispersion objects 1330.2) rather than layers of four rows and three rows as shown in FIG. 10B, energy-dispersion objects 1330.2 have a larger diameter than energy-dispersion objects 1330.1, and energy-dispersion objects 1330.1 are held in place by a single lock plate 1320. In some embodiments, the energy-dispersion objects 1330.1, 1330.2 and 1331 are spherical balls, and the relative sizes of balls 1331, balls 1330.2 and balls 1330.1 are as shown in FIG. 13. In other embodiments, the relative sizes of balls 1331, balls 1330.2 and balls 1330.1 are approximately as shown in FIG. 13.

In some embodiments, multi-purpose armor unit 1301 is configured to stop both EFP (explosively-formed penetrators) and RPG (rocket-propelled grenade) or other similar anti-armor-missile-delivered-shaped-charge warheads. In some embodiments, armor unit 1301 is further configured to defeat conventional armor-piercing (AP) ballistic projectiles such as bullets and long-rod penetrators (e.g., Sabot-dart anti-tank rounds from M1 tanks). In some embodiments, assembly 1303 is configured to stop the larger projectiles (e.g., EFP, long-rod Sabot-discarding penetrators, bullets, and the like), and assembly 1302 is configured to stop anti-armor, RPG-type shaped-charge warheads. In some embodiments, assembly 1302 works much like the ball-bearing layer in the bottom of a water-jet cutter sink that is employed to protect the catchment sink from being destroyed over time by the spray through the jet of the water jet. In some embodiments, the shaped surfaces of the smaller units in rear assembly 1302 serve to deflect, dissipate and divert the "stream" of shaped-charge penetrators.

FIG. 14 is a perspective view of an armor-enhanced stationary structure 1400. In some embodiments, each of the outer walls 1410 incorporate one or more of the designs of FIGS. 1B, 2A, 3A, 4, 9A-2, 10A-2, 11A, 11B, 12A, 13, and/or 14 as at least part of their armor.

Figure 15:
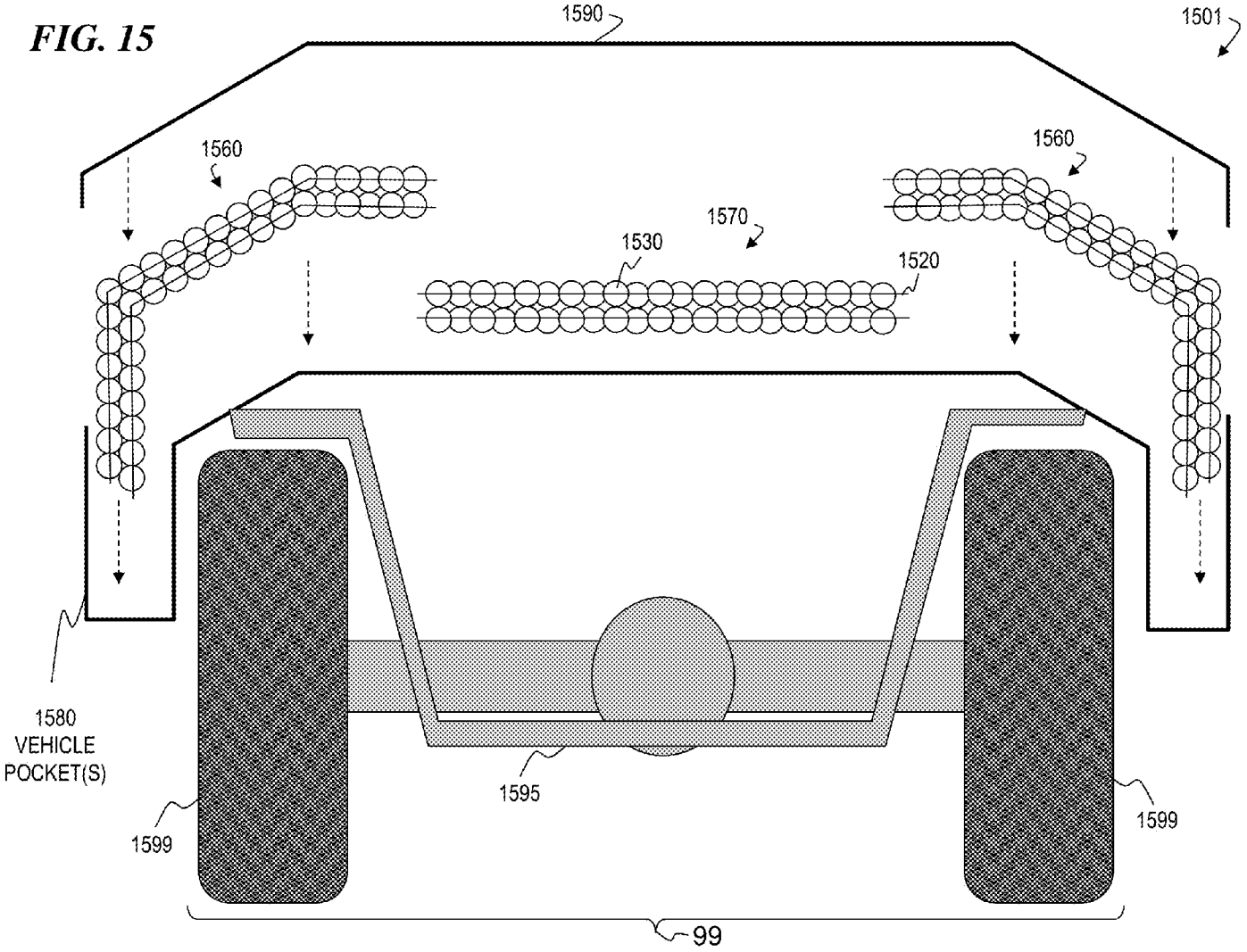
FIG. 15 is a cross-section of an armor-enhanced combat vehicle 1501.

FIG. 15 is a cross-section of an armor-enhanced combat vehicle 1501. In some embodiments, armor-enhanced combat vehicle 1501 includes a vehicle 99 that is protected by one or more sections of multi-planed armor component 1560 and single-plane armor component 1570. In some embodiments, armor component 1570 and/or multi-planed armor component 1560 each include a plurality of layers of heat treated and surface treated AGFN energy-dispersion objects 1530. In some embodiments, armor component 1570 and/or multi-planed armor component 1560 each include at least one layer of lock plates 1520 used to hold the energy-dispersion objects 1530 in place. In some embodiments, each one of the plurality of sections of armor component 1560 and/or armor component 1570 is attached to vehicle 99 by placing it in one of a plurality of corresponding vehicle pockets 1580. In some embodiments, the plurality of sections of armor component 1560 are connected to armor component 1570 (by bolting, by adhesive, by Velcro™ or by other suitable means) after the armor components 1560 are placed in pockets 1580. In other embodiments, the plurality of sections of armor component 1560 remain tightly abutted to but unconnected from armor component 1570 after the armor components 1560 are placed in pockets 1580. In some embodiments, a capping metal cover 1590 covers the top of the armor sections 1560 and 1570. In other embodiments, a cover 1590 made of molded-in-place polyurethane covers the top of and holds together the armor sections 1560 and 1570. In some embodiments, cover 1590 includes a high-durometer polyurethane such as 93A polyurethane. In some embodiments, vehicle 99 includes tires 1599 and underbelly armor 1595.

Figure 16:
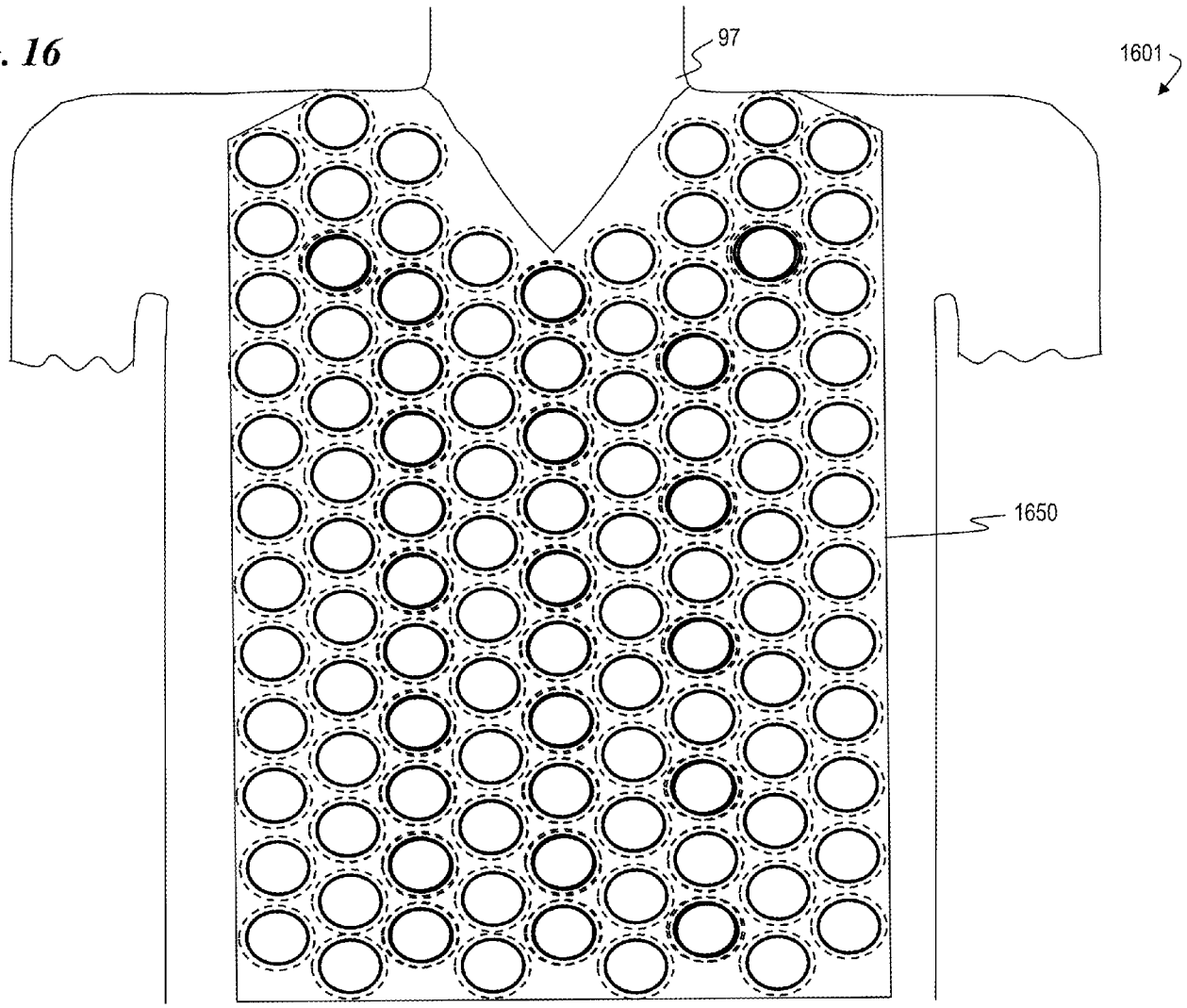
FIG. 16 is a schematic drawing of a body-armor system 1601 made according to the present invention.

FIG. 16 is a schematic drawing of a body-armor system 1601 made according to the present invention. In some embodiments, system 1601 includes an armor unit 1650 that is worn by a person 97. In some embodiments, armor unit 1650 uses the same AGFN technology described in other embodiments of the present invention except that the size of the plurality of energy-dispersion objects used in the armor unit 1650 is drastically reduced (e.g., in some embodiments, the energy-dispersion objects used in armor unit 1650 have a diameter of about 1.6 mm (1/16 inch), of about 3 mm (1/8 inch), of about 6 mm (1/4 inch), or any other suitable diameter) and/or individual components of previously described armor units are eliminated. For example, in some embodiments, lock-plates and fastener sets are removed and layers of energy-dispersion objects are embedded in a composite fiber jacket or vest that comprises armor unit 1650 worn by person 97.

In some embodiments, the present invention provides an armor system that includes a first armor article that includes a plurality of energy-dispersion objects arranged in a predetermined configuration, wherein the plurality of energy-dispersion objects includes a plurality of hardened-shell (initially hollow) objects, and wherein at least some of the plurality of hardened-shell objects are filled with a filler material; and a constraint mechanism configured to hold the plurality of energy-dispersion objects in the predetermined configuration. In some embodiments, the constraint mechanism includes a lock mechanism (e.g., steel plates with holes or indentations that hold the energy-dispersion objects in a matrix configuration; in other embodiments, a system of welds holds the objects to one another. In yet other embodiments, a simple container such as a steel box or cage is filled with the energy-dispersion objects. In some embodiments, two or more such containment mechanisms are used. In some embodiments, the matrix of energy-dispersion objects is encased in and held in place by a Kevlar® and/or fiberglass-filled epoxy or elastomer material.

In some embodiments of the armor system, the first armor article is one of a plurality of other armor articles each substantially similar to the first armor article; the armor system further including a vehicle, wherein the first armor article and the plurality of other armor articles are affixed to the vehicle to protect the vehicle from incoming weapons.

In some embodiments of the armor system, the plurality of hardened-shell objects is a plurality of hollow spheres. In some embodiments, the plurality of hollow objects is a plurality of hollow ovoids. In some embodiments, the plurality of hollow objects is a plurality of hollow cubes. In some embodiments, the plurality of hollow objects is a plurality of hollow cylinders, or other shapes suitable for energy dispersion of ballistic projectiles.

In some embodiments of the armor system, the predetermined configuration is a hexagonal-packed configuration. In some embodiments, the predetermined configuration is a square-packed configuration.

In some embodiments of the armor system, the lock mechanism includes a first, second, and third lock plate, wherein the plurality of hardened-shell objects includes a plurality of layers of hollow spheres, including a first layer of hollow spheres in a hexagonal-packed configuration and a second layer of hollow spheres arranged in a configuration that fills in gaps created by the hexagonal-packed configuration of the first layer of hollow spheres, wherein the first layer of hollow spheres is held in the hexagonal-packed configuration by the first and second lock plates, and wherein the second layer of hollow spheres is held in place by the third lock plate. In some embodiments, each sphere in the first layer of hollow spheres has a first outside diameter, and wherein each sphere in the second layer of hollow spheres has a second outside diameter that is smaller than the first outside diameter.

In some embodiments of the armor system, the lock mechanism includes a first, second, third, and fourth lock plate, wherein the plurality of hardened-shell objects includes a plurality of layers of hollow spheres, including a first layer of hollow spheres in a square-packed configuration and a second layer of hollow spheres arranged in a configuration that fills in gaps created by the square-packed configuration of the first layer of hollow spheres, wherein the first layer of hollow spheres are held in the square-packed configuration by a first and second lock plate, and wherein the second layer of hollow spheres are held in place with a third and fourth lock plate. In some embodiments, each sphere in the first layer of hollow spheres and each sphere in the second layer of hollow spheres has a first outside diameter.

In some embodiments of the armor system, the filler material includes a glass-filled nylon. In some embodiments, the filler material includes a glass-filled nylon and a bubbling agent. In some embodiments, the filler material includes a polyurethane. In some embodiments, each one of the plurality of hardened-shell objects are filled with a filler material that includes a glass-filled nylon and a bubbling agent.

In some embodiments of the armor system, the first armor article is encased within a polymer material.

In some embodiments, the armor system further includes a container, wherein the plurality of hardened-shell objects includes a first set of hollow spheres and a second set of hollow spheres, wherein the first set of hollow spheres are held in place within the container, wherein the second set of hollow spheres are held in a square-packed configuration with a first, second, and third lock plate, and wherein each one of the plurality of hollow objects are filled with a glass-filled nylon. In some embodiments, each one of the first set of hollow spheres has a first outside diameter, wherein a first plurality of the second set of hollow spheres has a second outside diameter that is larger than the first diameter, and wherein a second plurality of the second set of hollow spheres has a third outside diameter that is larger than the first diameter and different than the second diameter.

In some embodiments of the armor system, the first armor article is configured to conform to a substantially flat surface. In some embodiments, the first armor article is configured to conform to a substantially curved surface.

In some embodiments of the armor system, the first armor article is one of a plurality of other armor articles each substantially similar to the first armor article; the armor system further including a building, wherein the first armor article and the plurality of other armor articles are affixed to the building to protect the building from incoming weapons.

In some embodiments of the armor system, the first armor article is one of a plurality of other armor articles each substantially similar to the first armor article, wherein the plurality of armor articles are combined to form a body armor configured to protect a person from an incoming weapon.

In some embodiments of the armor system, each one of the plurality of hardened-shell objects is a hollow sphere made of a material that includes a metal. In some embodiments, each one of the plurality of hardened-shell objects is a hollow sphere made of a material that includes a metal alloy. In some embodiments, each one of the plurality of hardened-shell objects is a hollow sphere made of a material that includes steel.

In some embodiments of the armor system, the constraint mechanism includes at least one lock plate made from a material that includes steel. In some embodiments, the lock mechanism includes a plurality of lock plates, wherein each lock plate of the plurality of lock plates has a plurality of holes, wherein each one of the plurality of holes has a first diameter, wherein each one of the plurality of hollow objects has a second diameter that is larger than the first diameter such that a layer of the plurality of objects can be held in the predetermined configuration by at least one of the plurality of lock plates. In some embodiments, the plurality of lock plates includes a first lock plate and a second lock plate, wherein the layer of the plurality of hollow objects is held in the predetermined configuration between the first lock plate and the second lock plate, and wherein the lock mechanism further includes at least one fastener set configured to hold the first and second lock plates together. In some embodiments, the lock mechanism includes a weld that connects the plurality of energy-dispersion objects together. In some embodiments, the lock mechanism includes an electromagnetic mechanism.

In some embodiments, the armor system further includes a second armor article, wherein the first armor article and the second armor article are affixed to one another such that an air gap exists between the first armor article and the second armor article In some embodiments, the present invention provides a method for manufacturing a first armor article that includes producing a plurality of hollow hemispheres; welding pairs of the plurality of hollow hemispheres together to form a plurality of hollow spheres; forming an injection hole in each one of the plurality of hollow spheres; treating each one of the plurality of hollow spheres with an anti-ballistic treatment to form a plurality of energy-dispersion objects; injecting a filler material into at least some of the plurality of hollow spheres; and locking the plurality of energy-dispersion objects into a predetermined configuration.

In some embodiments of the method for manufacturing the first armor article, the first armor article is one of a plurality of other armor articles each substantially similar to the first armor article, and the method of manufacturing the armor system further includes providing a vehicle; and affixing the first armor article and the plurality of other armor articles to the vehicle to protect the vehicle from incoming weapons.

In some embodiments of the method for manufacturing the first armor article, the producing of the plurality of hollow hemispheres includes casting a plurality of hollow steel hemispheres. In some embodiments, the producing of the plurality of hollow hemispheres includes stamping a plurality of hollow steel hemispheres out of sheet steel.

In some embodiments of the method for manufacturing the first armor article, the welding of the pairs of the plurality of hollow hemispheres together includes spin welding the pairs together. In some embodiments, the welding of the pairs of the plurality of hollow hemispheres together includes laser welding the pairs together.

In some embodiments of the method for manufacturing the first armor article, the forming of the injection hole includes drilling the injection hole.

In some embodiments of the method for manufacturing the first armor article, the injecting of the filler material includes injecting a glass-filled nylon and a bubbling agent into at least some of the plurality of hollow spheres.

In some embodiments of the method for manufacturing the first armor article, the treating includes applying a case-hardening treatment to each one of the plurality of hollow spheres. In some embodiments, the applying of the case-hardening treatment includes applying a ferritic nitro-carburizing (FNC) treatment to each one of the plurality of hollow spheres. In some embodiments, the applying of the case-hardening treatment includes applying a carbonitriding treatment to each one of the plurality of hollow spheres. In some embodiments, the treating includes applying a heat treatment to each one of the plurality of hollow spheres. In some embodiments, the treating includes applying a tool-coat treatment to each one of the plurality of hollow spheres.

In some embodiments of the method for manufacturing the first armor article, the locking of the plurality of energy-dispersion objects includes placing the plurality of energy-dispersion objects in a least one lock plate. In some embodiments, the locking of the plurality of energy-dispersion objects includes placing a first layer of the plurality of energy-dispersion objects in between a first and second lock plate, and holding the first and second lock plate together with at least one fastener set.

In some embodiments of the method for manufacturing the first armor article, the method further includes providing a second armor article substantially similar to the first armor article; and affixing the first armor article and the second armor article to one another such that an air gap exists between the first armor article and the second armor article.

In some embodiments of the method for manufacturing the first armor article, the locking includes locking the plurality of energy-dispersion objects into a hexagonal-packed configuration. In some embodiments, the locking includes locking the plurality of energy-dispersion objects into a square-packed configuration.

In some embodiments, the present invention provides a first armor article that includes a plurality of metal lock plates; and at least one layer of energy-dispersion objects that includes a first plurality of energy-dispersion objects, wherein the first plurality of energy-dispersion objects in the first layer are held in place by at least two of the plurality of lock plates, and wherein the first plurality of energy-dispersion objects includes a plurality of hollow steel spheres, each hollow steel sphere injected with a glass-filled nylon material.

In some embodiments, the first armor article further includes a plurality of other armor articles each substantially similar to the first armor article; and a vehicle, wherein the first armor article and the plurality of other armor articles are affixed to the vehicle to protect the vehicle from incoming projectiles.

In some embodiments, the first armor article further includes a second armor article, wherein the first armor article and the second armor article are affixed to one another such that an air gap exists between the first armor article and the second armor article.

In some embodiments of the first armor article, the first plurality of hollow steel spheres is further injected with a bubbling agent.

In some embodiments, the present invention provides an armor system that includes a first armor article that includes a plurality of energy-dispersion objects arranged in a predetermined configuration, wherein the plurality of energy-dispersion objects includes a plurality of hollow objects, and wherein at least some of the plurality of hollow objects are filled with an inner filler material; and a lock mechanism configured to hold the plurality of energy-dispersion objects in the predetermined configuration.

In some embodiments of the armor system, the first armor article is one of a plurality of other armor articles each substantially similar to the first armor article; the armor system further including a vehicle, wherein the first armor article and the plurality of other armor articles are affixed to the vehicle to protect the vehicle from incoming weapons.

In some embodiments of the armor system, the plurality of hollow objects includes a plurality of hollow spheres. In some embodiments, the plurality of hollow objects includes a plurality of hollow ovoids. In some embodiments, the plurality of hollow objects includes a plurality of hollow cubes. In some embodiments, the plurality of hollow objects includes a plurality of hollow cylinders.

In some embodiments of the armor system, the predetermined configuration includes a hexagonal-packed configuration, wherein a majority of the plurality of hollow objects do not touch (are not in direct contact with) their respective nearest-neighbor hollow objects. In some embodiments, the majority includes all of the plurality of hollow objects in the first armor article. In some embodiments, the predetermined configuration includes a hexagonal-packed configuration. In some embodiments, the predetermined configuration includes a square-packed configuration.

In some embodiments of the armor system, the lock mechanism includes a first, second, and third lock plate, wherein the plurality of hollow objects includes a plurality of layers of hollow spheres, including a first layer of hollow spheres in a hexagonal-packed configuration and a second layer of hollow spheres, stacked on the first layer, and arranged in a configuration that fills in gaps created by the hexagonal-packed configuration of the first layer of hollow spheres, wherein the first layer of hollow spheres is held in the hexagonal-packed configuration by the first and second lock plates, and wherein the second layer of hollow spheres is held in place by the third lock plate. In some embodiments, each sphere in the first layer of hollow spheres has a first outside diameter, and wherein each sphere in the second layer of hollow spheres has a second outside diameter that is smaller than the first outside diameter.

In some embodiments of the armor system, the lock mechanism includes a first, second, third, and fourth lock plate, wherein the plurality of hollow objects includes a plurality of layers of hollow spheres stacked one layer upon another, including a first layer of hollow spheres in a square-packed configuration and a second layer of hollow spheres, stacked on the first layer, and arranged in a configuration that fills in gaps created by the square-packed configuration of the first layer of hollow spheres, wherein the first layer of hollow spheres are held in the square-packed configuration by a first and second lock plate, and wherein the second layer of hollow spheres are held in place with a third and fourth lock plate. In some embodiments, each sphere in the first layer of hollow spheres has a diameter and each sphere in the second layer of hollow spheres has a diameter, and the diameters of each sphere in the first layer of hollow spheres are equal to one another and to the diameters of each sphere in the second layer of hollow spheres.

In some embodiments of the armor system, the inner filler material includes a glass-filled nylon. In some embodiments, the inner filler material includes a glass-filled nylon and a bubbling agent. In some embodiments, the inner filler material includes a polyurethane. In some embodiments, all of the plurality of hollow objects are filled with the inner filler material, and wherein the inner filler material includes a glass-filled nylon and a bubbling agent. In some embodiments, the first armor article is encased within an exterior encasing material that includes a polymer.

In some embodiments, the armor system further includes a container, wherein the plurality of hollow objects includes a first set of hollow spheres and a second set of hollow spheres, wherein the first set of hollow spheres are held in place within the container, wherein the second set of hollow spheres are held in a square-packed configuration with a first, second, and third lock plate, and wherein each one of the plurality of hollow objects is filled with a glass-filled nylon.

In some embodiments, the armor system further includes a container, wherein the plurality of hollow objects includes a first set of hollow spheres and a second set of hollow spheres, wherein the first set of hollow spheres are held in place within the container, wherein the second set of hollow spheres are held in a square-packed configuration with a first, second, and third lock plate, and wherein each one of the plurality of hollow objects is filled with a glass-filled nylon, wherein each one of the first set of hollow spheres has a first outside diameter, wherein a first plurality of the second set of hollow spheres has a second outside diameter that is larger than the first diameter, and wherein a second plurality of the second set of hollow spheres has a third outside diameter that is larger than the first diameter and different than the second diameter.

In some embodiments of the armor system, the first armor article is configured to conform to a substantially flat vehicle surface. In some embodiments, the first armor article is configured to conform to a curved vehicle surface.

In some embodiments, the armor system further includes a plurality of other armor articles each substantially similar to the first armor article; and a building, wherein the first armor article and the plurality of other armor articles are affixed to the building to protect the building from incoming projectiles.

In some embodiments, the armor system further includes a plurality of other armor articles each substantially similar to the first armor article, wherein the first armor article and the plurality of other armor articles are combined to form a body armor configured to protect a person from incoming projectiles.

In some embodiments of the armor system, each one of the plurality of hollow objects is a hollow sphere made of a material that includes a metal. In some embodiments, each one of the plurality of hollow objects is a hollow sphere made of a metal alloy. In some embodiments, each one of the plurality of hollow objects is a hollow sphere made of a material that includes steel.

In some embodiments of the armor system, the lock mechanism includes at least one lock plate made from steel. In some embodiments, the lock mechanism includes a plurality of lock plates, wherein each lock plate of the plurality of lock plates has a plurality of holes, wherein each one of the plurality of holes has a first size, wherein each one of the plurality of hollow objects has a size that is larger than the first size such that a layer of the plurality of objects can be held in the predetermined configuration by at least one of the plurality of lock plates. In some embodiments, the plurality of lock plates includes a first lock plate and a second lock plate, wherein the layer of the plurality of hollow objects is held in the predetermined configuration between the first lock plate and the second lock plate, and wherein the lock mechanism further includes at least one fastener set configured to hold the first and second lock plates together. In some embodiments, the lock mechanism includes welds that connect the plurality of energy-dispersion objects together. In some embodiments, the lock mechanism includes an electromagnetic mechanism.

In some embodiments, the armor system further includes a second armor article, wherein the first armor article and the second armor article are affixed to one another in a manner that forms an air gap between the first armor article and the second armor article.

In some embodiments, the present invention provides a method for manufacturing an armor system, the armor system including a first armor article, the method including producing a plurality of hollow hemispheres; affixing pairs of the plurality of hemispheres to one another to form a first plurality of spheres; inserting a filler material into each one of the hollow hemispheres to form a plurality of filled hemispheres; treating each one of the plurality of spheres with an anti-ballistic treatment to form a plurality of energy-dispersion objects; and locking the plurality of energy-dispersion objects into a predetermined configuration.

In some embodiments, the inserting of the filler material into each of the plurality of hemispheres is performed before affixing the pairs of hemispheres together. In some embodiments, the affixing of pairs of the plurality of hemispheres to one another to form the first plurality of spheres is performed before inserting of the filler material, the method further comprising forming an injection hole in each one of the plurality of spheres, and wherein the inserting includes injecting the filler material through the injection hole. In some embodiments, the inserting of the filler material into each of the plurality of hemispheres is performed as part of the affixing of the pairs of hemispheres together.

In some embodiments, the method further includes manufacturing a plurality of other armor articles each substantially similar to the first armor article; providing a vehicle; and affixing the first armor article and the plurality of other armor articles to the vehicle to protect the vehicle from incoming projectiles.

In some embodiments of the method for manufacturing the armor system, the producing of the plurality of hollow hemispheres includes casting the plurality of hollow hemispheres from steel. In some embodiments, the producing of the plurality of hollow hemispheres includes stamping the plurality of hollow hemispheres out of sheet steel.

In some embodiments of the method for manufacturing the armor system, the affixing includes welding the pair of hemispheres together. In some embodiments, the welding of the pairs of the plurality of hollow hemispheres together includes spin welding the pairs together. In some embodiments, the welding of the pairs of the plurality of hollow hemispheres together includes laser welding the pairs together.

In some embodiments of the method for manufacturing the armor system, the forming of the injection hole includes drilling the injection hole. In some embodiments, the injecting of the filler material includes injecting a glass-filled nylon and a bubbling agent into at least some of the plurality of hollow spheres.

In some embodiments of the method for manufacturing the armor system, the treating includes applying a case-hardening treatment to each one of the plurality of spheres. In some embodiments, the treating includes applying a case-hardening treatment to each one of the plurality of spheres, and wherein the applying of the case-hardening treatment includes applying a ferritic nitrocarburizing (FNC) treatment to each one of the plurality of hollow spheres. In some embodiments, the treating includes applying a case-hardening treatment to each one of the plurality of spheres, and wherein the applying of the case-hardening treatment includes applying a carbonitriding treatment to each one of the plurality of hollow spheres. In some embodiments, the treating includes applying a heat treatment to each one of the plurality of hollow spheres. In some embodiments, the treating includes applying a tool-coat treatment to each one of the plurality of hollow spheres.

In some embodiments of the method for manufacturing the armor system, the locking of the plurality of energy-dispersion objects includes placing the plurality of energy-dispersion objects between a pair of lock plates. In some embodiments, the locking of the plurality of energy-dispersion objects includes placing some of the plurality of energy-dispersion objects between a first lock plate and a second lock plate, and placing a remainder of the plurality of energy-dispersion objects between the second lock plate and a third lock plate, and holding the first and second lock plate together with at least one fastener set.

In some embodiments, the method for manufacturing the armor system further includes manufacturing a second armor article substantially similar to the first armor article; and affixing the first armor article and the second armor article to one another and forming an air gap between the first armor article and the second armor article.

In some embodiments of the method for manufacturing the armor system, the locking includes locking the plurality of energy-dispersion objects into a hexagonal-packed configuration. In some embodiments, the locking includes locking the plurality of energy-dispersion objects into a square-packed configuration.

In some embodiments, the present invention provides a first armor article that includes a plurality of metal lock plates including a first metal lock plate and a second metal lock plate; and a first layer of energy-dispersion objects that includes a first plurality of energy-dispersion objects, wherein the first plurality of energy-dispersion objects in the first layer are held in place by and between the first lock plate and the second lock plate, and wherein the first plurality of energy-dispersion objects includes a plurality of hollow steel spheres, each steel sphere filled with a glass-filled nylon material.

In some embodiments, the first armor article further includes a plurality of other armor articles each substantially similar to the first armor article; and a vehicle, wherein the first armor article and the plurality of other armor articles are affixed to the vehicle to protect the vehicle from incoming projectiles.

In some embodiments, the first armor article further includes a second armor article, wherein the first armor article and the second armor article are affixed to one another such that an air gap exists between the first armor article and the second armor article.

In some embodiments of the first armor article, the first plurality of hollow steel spheres is further injected with a bubbling agent.

In some embodiments, the present invention provides a system for forming a first armor article, the system including a plurality of hollow hemispheres; means for affixing pairs of the plurality of hemispheres to one another to form a first plurality of spheres; means for inserting a filler material into each one of the hollow hemispheres to form a plurality of filled hemispheres; means for treating each one of the plurality of spheres to form a plurality of energy-dispersion objects; and means for locking the plurality of energy-dispersion objects into a predetermined configuration.

In some embodiments of the system for forming the first armor article, the means for affixing include means for welding the pair of hemispheres together. In some embodiments, the means for treating includes means for applying a case-hardening treatment to each one of the plurality of spheres. In some embodiments, the means for treating includes means for applying a heat treatment to each one of the plurality of spheres. In some embodiments, the system further includes a plurality of other armor articles each substantially similar to the first armor article; a vehicle; and means for affixing the first armor article and the plurality of other armor articles to the vehicle to protect the vehicle from incoming projectiles.

In some embodiments, the present invention provides a method for manufacturing an armor system, the armor system including a first armor article, the method including producing a plurality of hollow hemispheres; affixing pairs of the plurality of hemispheres to one another to form a first plurality of spheres; treating each one of the plurality of hemispheres with an anti-ballistic treatment; inserting a filler material into each one of the plurality of hemispheres; and locking the first plurality of spheres into a predetermined configuration.

In some embodiments, the method for manufacturing the armor system further includes forming an injection hole in each one of the first plurality of spheres, wherein the treating includes applying a heat treatment to each one of the first plurality of spheres, and wherein the inserting includes injecting the filler material into each one of the first plurality of spheres through the injection hole after the applying of the heat treatment. In some embodiments, the treating includes applying a heat treatment and a surface treatment to each one of the first plurality of spheres.

It is to be understood that the above description is intended to be illustrative, and not restrictive. Although numerous characteristics and advantages of various embodiments as described herein have been set forth in the foregoing description, together with details of the structure and function of various embodiments, many other embodiments and changes to details will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects. It is further to be understood that the individual components of the embodiments described above can be interchanged with each other such that components from separately described embodiments and/or Figures can be combined and/or omitted to create additional embodiments of the present invention.

What is claimed is:

1. A method for manufacturing an armor system that includes a first armor article, the method comprising:

producing the first armor article, wherein the producing of the first armor article includes:

providing a first plurality of energy-dispersion objects, wherein each one of the first plurality of energy-dispersion objects is made from a first material;

treating each one of the first plurality of energy-dispersion objects with an anti-ballistic treatment;

inserting a filler material into each one of the first plurality of energy-dispersion objects, wherein the inner filler material is different than the first material; and constraining the first plurality of energy-dispersion objects into a predetermined configuration, wherein the constraining of the first plurality of energy-dispersion objects includes packing the first plurality of energy-dispersion objects into a container.

2. The method of claim 1, further comprising:

producing a plurality of other armor articles each substantially similar to the first armor article;

providing a vehicle; and affixing the first armor article and the plurality of other armor articles to the vehicle to protect the vehicle from incoming projectiles.

3. The method of claim 1, wherein the first plurality of energy-dispersion objects includes a plurality of hollow spheres.

4. The method of claim 1, wherein the first plurality of energy-dispersion objects includes a plurality of hollow spheres, wherein the producing of the first armor article further includes:

producing a plurality of hollow hemispheres; and affixing pairs of the plurality of hollow hemispheres to one another to form the plurality of hollow spheres.

5. The method of claim 1, wherein the first plurality of energy-dispersion objects includes a plurality of hollow spheres, wherein the producing of the first armor article further includes:

producing a plurality of hollow hemispheres; and affixing pairs of the plurality of hollow hemispheres to one another to form the plurality of hollow spheres, wherein the affixing includes welding the pair of hemispheres together.

6. The method of claim 1, wherein the plurality of energy-dispersion objects includes a plurality of hollow spheres, wherein the producing of the first armor article further includes:

producing a plurality of hollow hemispheres, wherein the producing of the plurality of hollow hemispheres includes casting the plurality of hollow hemispheres from steel; and affixing pairs of the plurality of hollow hemispheres to one another to form the plurality of hollow spheres.

7. The method of claim 1, wherein the producing of the first armor article further includes:

forming an injection hole in each one of the plurality of energy-dispersion objects, wherein the treating includes applying a heat treatment to each one of the first plurality of energy-dispersion objects, and wherein the inserting includes injecting the filler material into each one of the first plurality of energy-dispersion objects through the injection hole after the applying of the heat treatment.

8. The method of claim 1, wherein the first material includes steel.

9. The method of claim 1, wherein the inserting of the filler material includes injecting a glass-filled nylon into the first plurality of energy-dispersion objects.

10. The method of claim 1, wherein the inserting of the filler material includes inserting a glass into the first plurality of energy-dispersion objects.

11. The method of claim 1, wherein the treating includes applying a heat treatment and a surface treatment to each one of the first plurality of energy-dispersion objects.

12. The method of claim 1, wherein the treating includes case hardening each one of the first plurality of energy-dispersion objects.

13. The method of claim 1, wherein the treating includes applying a case-hardening treatment to each one of the first plurality of energy-dispersion objects, and wherein the applying of the case-hardening treatment includes applying a ferritic nitrocarburizing (FNC) treatment to each one of the first plurality of energy-dispersion objects.

14. A method for manufacturing an armor system that includes a first armor article, the method comprising:

producing the first armor article, wherein the producing of the first armor article includes:

providing a first plurality of energy-dispersion objects, wherein each one of the first plurality of energy-dispersion objects is made from a first material;

treating each one of the first plurality of energy-dispersion objects with an anti-ballistic treatment;

inserting a filler material into each one of the first plurality of energy-dispersion objects, wherein the inner filler material is different than the first material; and constraining the first plurality of energy-dispersion objects into a predetermined configuration, wherein the constraining of the first plurality of energy-dispersion objects includes encasing the first plurality of energy-dispersion objects in a polymer.

15. A method for protecting a combat vehicle from incoming projectiles, the method comprising:

producing a plurality of armor articles including a first armor article and a second armor article, wherein the first armor article includes a first plurality of hardened-shell energy-dispersion objects, wherein each one of the first plurality of hardened-shell energy-dispersion objects has a shell made from a first material, and wherein each one of the first plurality of hardened-shell energy-dispersion objects is filled with an inner filler material that is different than the first material;

providing a vehicle having an exterior;

attaching a plurality of armor-containment pockets to the exterior of the vehicle; and affixing the plurality of armor articles to the vehicle, wherein the affixing of the plurality of armor articles includes placing at least the first armor article in one of the plurality of armor-containment pockets.

16. The method of claim 15, wherein the first armor article has multiple planes, and wherein the second armor article has a single plane.

17. The method of claim 15, wherein the plurality of armor articles includes a third armor article, the method further comprising affixing the third armor article to an underbelly of the vehicle.

18. The method of claim 15, further comprising placing a cover over a top portion of the plurality of armor articles.

19. A system for forming a first armor article, the system comprising:

a first plurality of energy-dispersion objects, wherein each one of the first plurality of energy-dispersion objects is made from a first material, and wherein the first plurality of energy-dispersion objects includes a plurality of hollow spheres;

means for treating each one of the first plurality of energy-dispersion objects with an anti-ballistic treatment;

means for inserting a filler material into each one of the first plurality of energy-dispersion objects, wherein the inner filler material is different than the first material; and means for constraining the first plurality of energy-dispersion objects into a predetermined configuration.

20. The system of claim 19, wherein the means for constraining the first plurality of energy-dispersion objections includes a container.

* * * * *